US008842857B2

(12) United States Patent
Jiang et al.

(10) Patent No.: US 8,842,857 B2
(45) **Date of Patent: *Sep. 23, 2014**

(54) THERMOACOUSTIC DEVICE

(75) Inventors: Kai-Li Jiang, Beijing (CN); Xiao-Yang Lin, Beijing (CN); Lin Xiao, Beijing (CN); Shou-Shan Fan, Beijing (CN)

(73) Assignees: Tsinghua University, Beijing (CN); Hon Hai Precision Industry Co., Ltd., New Taipei (TW)

( * ) Notice: Subject to any disclaimer, the term of this patent is extended or adjusted under 35 U.S.C. 154(b) by 0 days.

This patent is subject to a terminal disclaimer.

(21) Appl. No.: 13/338,282

(22) Filed: Dec. 28, 2011

(65) Prior Publication Data

US 2012/0250908 A1 Oct. 4, 2012

(30) Foreign Application Priority Data

Mar. 29, 2011 (CN) ..... 2011 1 0076776

(51) Int. Cl.
*H04R 25/00* (2006.01)
*H04R 23/00* (2006.01)

(52) U.S. Cl.
CPC ..... *H04R 23/002* (2013.01)
USPC ..... 381/164

(58) Field of Classification Search
CPC ..... H04R 23/002
USPC ..... 381/164; 977/742
See application file for complete search history.

(56) References Cited

U.S. PATENT DOCUMENTS 7,261,352 B2 8/2007 Maslov et al.
8,300,855 B2 * 10/2012 Liu et al. ..... 381/164
2007/0284557 A1 * 12/2007 Gruner et al. ..... 252/500
2008/0170982 A1 7/2008 Zhang et al.
2009/0243637 A1 * 10/2009 Okai et al. ..... 324/724
2009/0268563 A1 10/2009 Jiang et al.
2010/0046774 A1 2/2010 Feng et al.
2010/0166232 A1 7/2010 Liu et al.
2010/0260358 A1 10/2010 Liu
2010/0260359 A1 10/2010 Liu
2011/0017921 A1 1/2011 Jiang et al.
2011/0051973 A1 3/2011 Liu et al.
2012/0012796 A1 1/2012 Chen et al.

FOREIGN PATENT DOCUMENTS

CN 101474898 7/2009
CN 101734650 6/2010
CN 101771915 7/2010
CN 101783995 7/2010
CN 101783996 7/2010
CN 101820572 9/2010

(Continued)

OTHER PUBLICATIONS

F Bonaccorso et al.; "Graphene photonics and optoelectronics" Nature Photonics, vol. 4, p. 611-622, Jun. 2010.

*Primary Examiner* — Brian Ensey
*Assistant Examiner* — Norman Yu
(74) *Attorney, Agent, or Firm* — Novak Druce Connolly Bove + Quigg LLP

(57) ABSTRACT

A thermoacoustic device includes a sound wave generator and a signal input device. The sound wave generator includes a composite structure. The composite structure includes a carbon nanotube film structure and a graphene film. The carbon nanotube film structure includes a number of carbon nanotubes and micropores. The graphene film is located on a surface of the carbon nanotube film structure, and covers the micropores.

20 Claims, 33 Drawing Sheets

(56) References Cited

FOREIGN PATENT DOCUMENTS

| | | |
|---|---|---|
| CN | 101964292 | 2/2011 |
| JP | 2009-43939 | 2/2009 |
| JP | 2010-52972 | 3/2010 |
| JP | 2011-26194 | 2/2011 |

* cited by examiner

THERMOACOUSTIC DEVICE

RELATED APPLICATIONS

This application claims all benefits accruing under 35 U.S.C. §119 from China Patent Application No. 201110076776.8, filed on Mar. 29, 2011, in the China Intellectual Property Office, the disclosures of which are incorporated herein by reference.

BACKGROUND

1. Technical Field

The present disclosure relates to acoustic devices and, particularly, to a thermoacoustic device.

2. Description of Related Art

Acoustic devices generally include a signal device and a sound wave generator electrically connected to the signal device. The signal device inputs signals to the sound wave generator, such as loudspeakers. A loudspeaker is an electro-acoustic transducer that converts electrical signals into sound.

There are different types of loudspeakers that can be categorized according to their working principle, such as electro-dynamic loudspeakers, electromagnetic loudspeakers, electrostatic loudspeakers, and piezoelectric loudspeakers. These various types of loudspeakers use mechanical vibration to produce sound waves. In other words they all achieve "electro-mechanical-acoustic" conversion. Among the various types, the electro-dynamic loudspeakers are the most widely used.

A thermophone based on the thermoacoustic effect was made by H. D. Arnold and I. B. Crandall (H. D. Arnold and I. B. Crandall, "The thermophone as a precision source of sound," Phys. Rev. 10, pp 22-38 (1917)). However, the thermophone adopting the platinum strip produces weak sounds because the heat capacity per unit area of the platinum strip is too high.

What is needed, therefore, is to provide a thermoacoustic device having good sound effect and high efficiency.

BRIEF DESCRIPTION OF THE DRAWINGS

Many aspects of the embodiments can be better understood with reference to the following drawings. The components in the drawings are not necessarily drawn to scale, the emphasis instead being placed upon clearly illustrating the principles of the embodiments. Moreover, in the drawings, like reference numerals designate corresponding parts throughout the several views.

DETAILED DESCRIPTION

The disclosure is illustrated by way of example and not by way of limitation in the figures of the accompanying drawings in which like references indicate similar elements. It should be noted that references to "an" or "one" embodiment in this disclosure are not necessarily to the same embodiment, and such references mean at least one.

Figure 1:
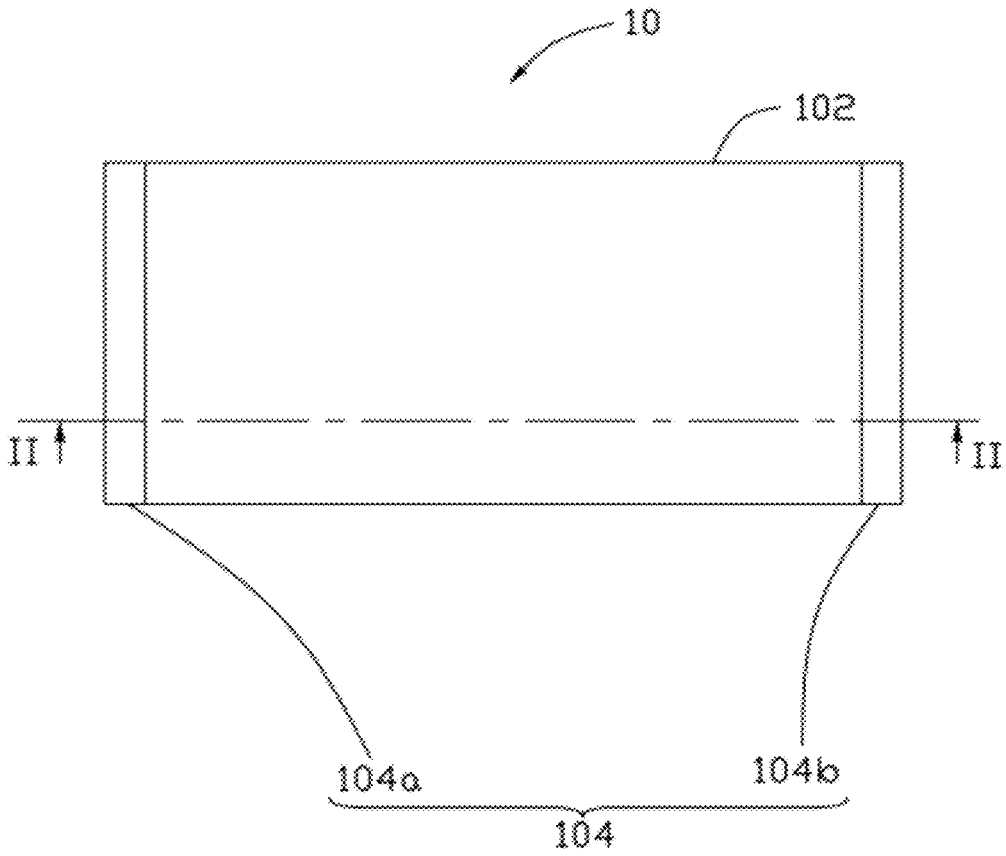
FIG. 1 is a schematic top plan view of one embodiment of a thermoacoustic device.
Figure 2:
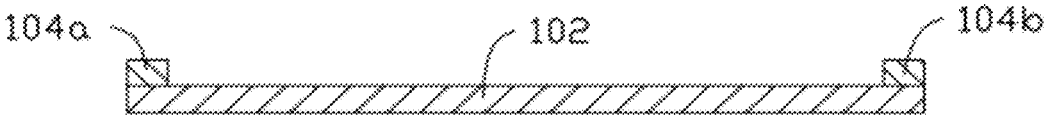
FIG. 2 is a cross-sectional view taken along a line II-II of the thermoacoustic device in FIG. 1.

Referring to FIGS. 1 and 2, a thermoacoustic device 10 in one embodiment includes a sound wave generator 102 and a signal input device 104. The sound wave generator 102 is capable of producing sounds by a thermoacoustic effect. The signal input device 104 is configured to input signals to the sound wave generator 102 to generate heat.

Sound Wave Generator

The sound wave generator 102 has a very small heat capacity per unit area. The sound wave generator 102 can be a conductive structure with a small heat capacity per unit area and a small thickness. The sound wave generator 102 can have a large specific surface area causing pressure oscillation in the surrounding medium by temperature waves generated by the sound wave generator 102. The sound wave generator 102 can be a free-standing structure. The term "free-standing" includes, but is not limited to, a structure that does not have to be supported by a substrate and can sustain its own weight when hoisted by a portion thereof without any significant damage to its structural integrity. That is to say, at least part of the sound wave generator can be suspended. The suspended part of the sound wave generator 102 will have more contact with the surrounding medium (e.g., air) and provide heat exchange with the surrounding medium from both sides of the sound wave generator 102. The sound wave generator 102 is a thermoacoustic film. The sound wave generator 102 has a small heat capacity per unit area, and a large surface area for causing the pressure oscillation in the surrounding medium by the temperature waves generated by the sound wave generator 102.

Figure 3:
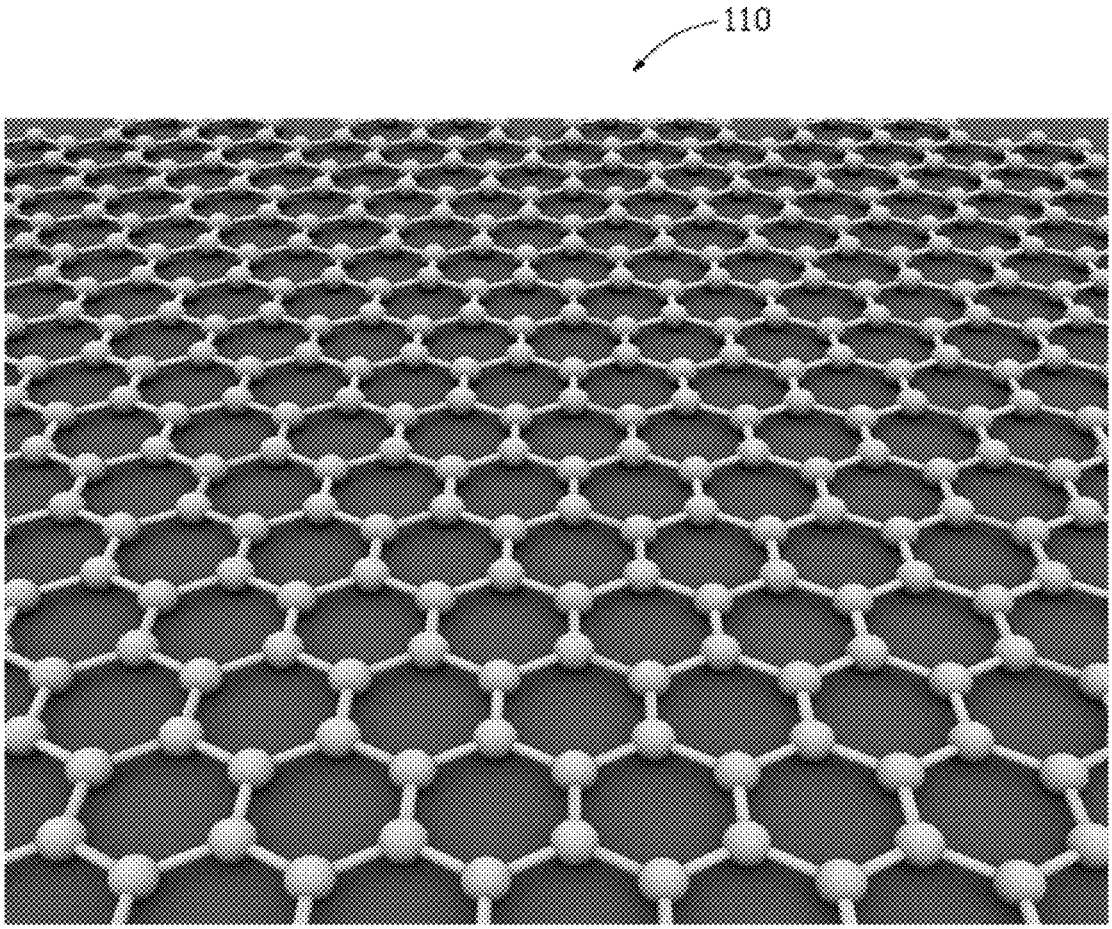
FIG. 3 is a structural view of a graphene structure.

In some embodiments, the sound wave generator 102 can be or include a graphene film. The graphene film includes at least one graphene. Referring to FIG. 3, the graphene is a one-atom-thick planar sheet of $sp^2$-bonded carbon atoms that are densely packed in a honeycomb crystal lattice. The size of the graphene can be very large (e.g., several millimeters). However, the size of the graphene is generally less than 10 microns (e.g., 1 micron). A thickness of graphene can be less than 100 nanometers. In one embodiment, the thickness of graphene can be in a range from about 0.5 nanometers to about 100 nanometers. In one embodiment, the graphene film is a pure structure of graphene. The graphene film can be or include a single graphene or a plurality of graphenes. In one embodiment, the graphene film includes a plurality of graphenes, the plurality of graphenes is stacked on top of each other or located side by side to form a thick or large film. The plurality of graphenes is combined with each other by van der Waals attractive force. The graphene film can be a continuous integrated structure. The term "continuous integrated structure" can be defined as a structure that is combined by a plurality of chemical covalent bonds (e.g., $sp^2$ bonds, $sp^1$ bonds, or $sp^3$ bonds) to form an overall structure. A thickness of the graphene film can be less than 1 millimeter. A heat capacity per unit area of the graphene film can be less than or equal to about $2\times10^{-3}$ J/cm$^2$*K. In some embodiments, a heat capacity per unit area of the graphene film can be less than or equal to about $5.57\times10^{-4}$ J/cm$^2$*K. The graphene film can be a free-standing structure. The graphene has large specific surface. A transmittance of visible lights of the graphene film can be in a range from 67% to 95%.

In other embodiments, the sound wave generator 102 can be or include a graphene/carbon nanotube composite structure including at least one carbon nanotube film structure and at least one graphene layer. The graphene/carbon nanotube composite structure can consist of the carbon nanotube film structure and the graphene film. The at least one carbon nanotube film structure and the at least one grapheme are stacked with each other. The graphene/carbon nanotube composite structure can include a number of carbon nanotube film structures and a number of grapheme layers alternatively stacked on each other. The carbon nanotube film structure and the graphene layer can combine with each other via van der Waals attractive force. The carbon nanotube film structure can include a plurality of micropores defined by adjacent carbon nanotubes, with the graphene film covering the plurality of micropores. Diameters of the micropores can be in a range from about 1 micrometer to about 20 micrometers. A thickness of the graphene/carbon nanotube composite structure can be in a range from 10 nanometers to about 1 millimeter. The length and width of the graphene/carbon nanotube composite structure are not limited.

The carbon nanotube film structure includes a number of carbon nanotubes. The carbon nanotube film structure can be a pure structure of carbon nanotubes. The carbon nanotubes in the carbon nanotube film structure are combined by van der Waals attractive force therebetween. The carbon nanotube film structure has a large specific surface area (e.g., above 30 m$^2$/g). The larger the specific surface area of the carbon nanotube film structure, the smaller the heat capacity per unit area. The smaller the heat capacity per unit area, the higher the sound pressure level of the sound produced by the sound wave generator 102. The thickness of the carbon nanotube film structure can range from about 0.5 nanometers to about 1 millimeter. The carbon nanotube film structure can include a number of pores. The pores are defined by adjacent carbon nanotubes. A diameter of the pores can be less 50 millimeters, in some embodiment, the diameter of the pores is less 10 millimeters. A heat capacity per unit area of the graphene film can be less than or equal to about $2\times10^{-3}$ J/cm$^2$*K. In some embodiments, a heat capacity per unit area of the graphene film can be less than or equal to about $1.7\times10^{-4}$ J/cm$^2$*K.

The carbon nanotubes in the carbon nanotube film structure can be orderly or disorderly arranged. The term 'disordered carbon nanotube film structure' refers to a structure where the carbon nanotubes are arranged along different directions, and the aligning directions of the carbon nanotubes are random. The number of the carbon nanotubes arranged along each different direction can be almost the same (e.g. uniformly disordered). The carbon nanotubes in the disordered carbon nanotube film structure can be entangled with each other. The carbon nanotube film structure including ordered carbon nanotubes is an ordered carbon nanotube film structure. The term 'ordered carbon nanotube film structure' refers to a structure where the carbon nanotubes are arranged in a consistently systematic manner, e.g., the carbon nanotubes are arranged approximately along a same direction and/or have two or more sections within each of which the carbon nanotubes are arranged approximately along a same direction (different sections can have different directions). The carbon nanotubes in the carbon nanotube film structure can be single-walled, double-walled, or multi-walled carbon nanotubes. The carbon nanotube film structure can include at least one carbon nanotube film. In other embodiments, the carbon nanotube film structure is composed of one carbon nanotube film or at least two carbon nanotube films. In other embodiments, the carbon nanotube film structure consists of one carbon nanotube film or at least two carbon nanotube films.

Figure 4:
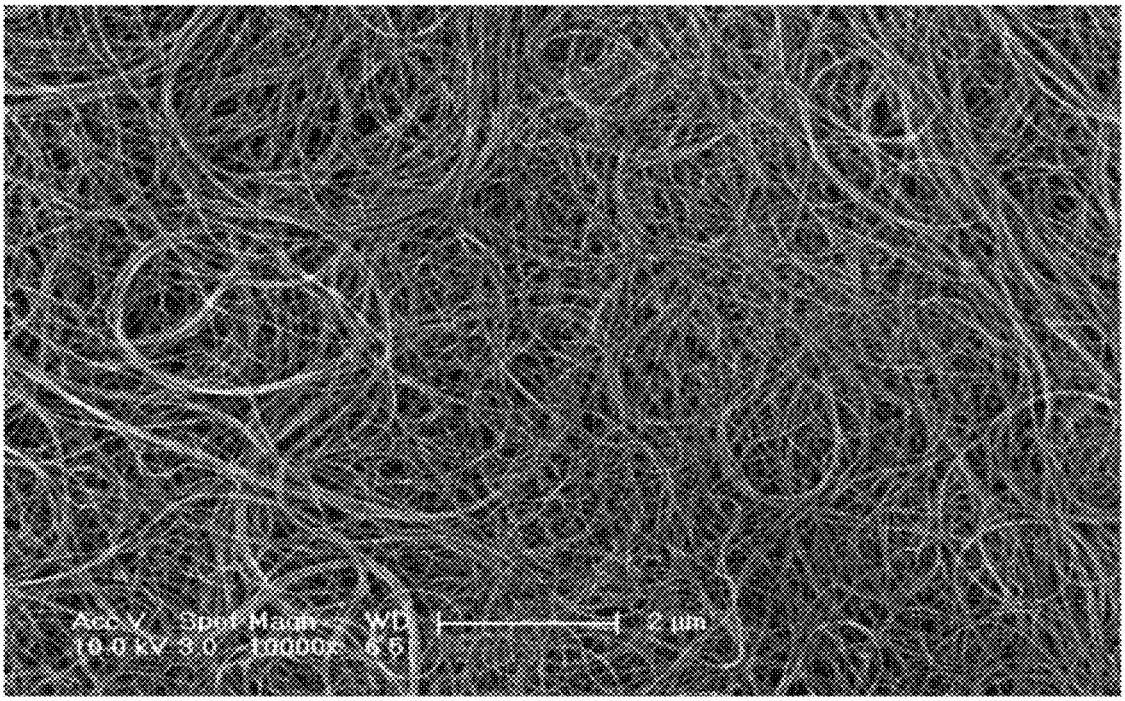
FIG. 4 is an SEM image of a flocculated carbon nanotube film.

In other embodiments, the carbon nanotube film can be a flocculated carbon nanotube film. Referring to FIG. 4, the flocculated carbon nanotube film can include a plurality of long, curved, disordered carbon nanotubes entangled with each other. The carbon nanotubes can be substantially uniformly dispersed in the carbon nanotube film. Adjacent carbon nanotubes are acted upon by van der Waals attractive force to obtain an entangled structure with micropores defined therein. Because the carbon nanotubes in the carbon nanotube film are entangled with each other, the carbon nanotube film structure employing the flocculated carbon nanotube film has excellent durability, and can be fashioned into desired shapes with a low risk to the integrity of the carbon nanotube film structure. The thickness of the flocculated carbon nanotube film can range from about 0.5 nanometers to about 1 millimeter.

Figure 5:
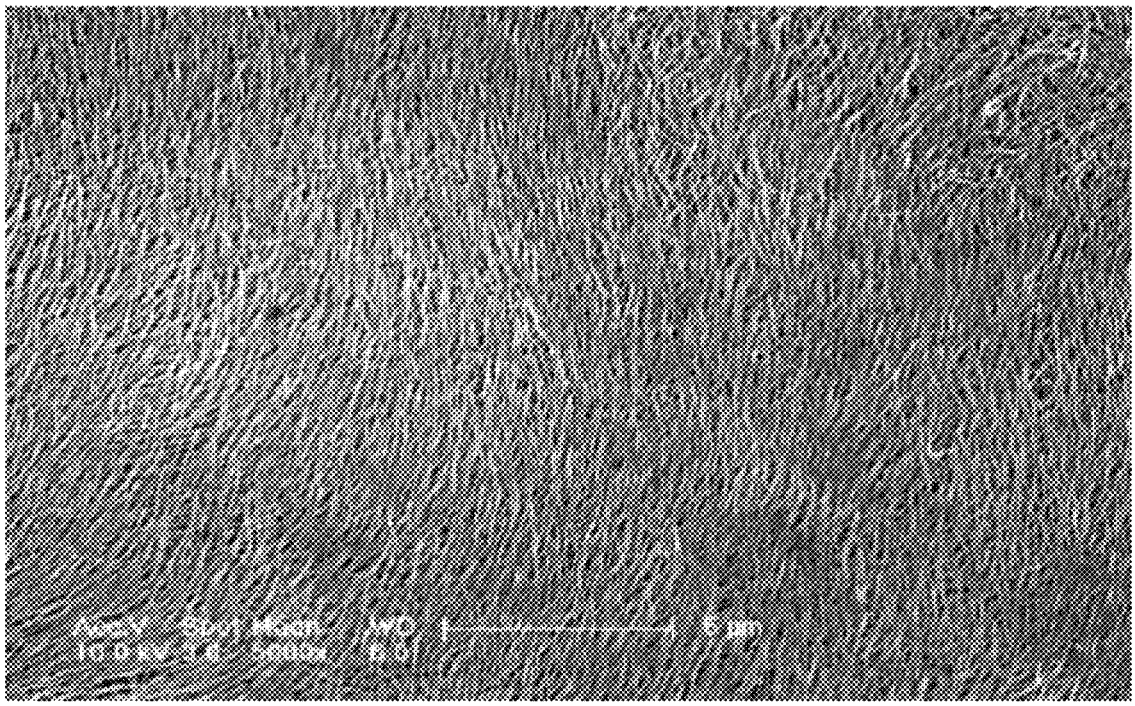
FIG. 5 is an SEM image of a pressed carbon nanotube film.

Referring to FIG. 5, in other embodiments, the carbon nanotube film can be a pressed carbon nanotube film. The pressed carbon nanotube film is formed by pressing a carbon nanotube array. The carbon nanotubes in the pressed carbon nanotube film are arranged along a same direction or along different directions. The carbon nanotubes in the pressed carbon nanotube film can rest upon each other. Adjacent carbon nanotubes are attracted to each other and are joined by van der Waals attractive force. An angle between a primary alignment direction of the carbon nanotubes and a surface of the pressed carbon nanotube film is about 0 degrees to approximately 15 degrees. The greater the pressure applied, the smaller the angle obtained. In one embodiment, the carbon nanotubes in the pressed carbon nanotube film are arranged along different directions, the carbon nanotubes can be uniformly arranged in the pressed carbon nanotube film. Some properties of the pressed carbon nanotube film are the same along the direction substantially parallel to the surface of the pressed carbon nanotube film, such as conductivity, intensity, etc. The thickness of the pressed carbon nanotube film can range from about 0.5 nanometers to about 1 millimeter.

Figure 6:
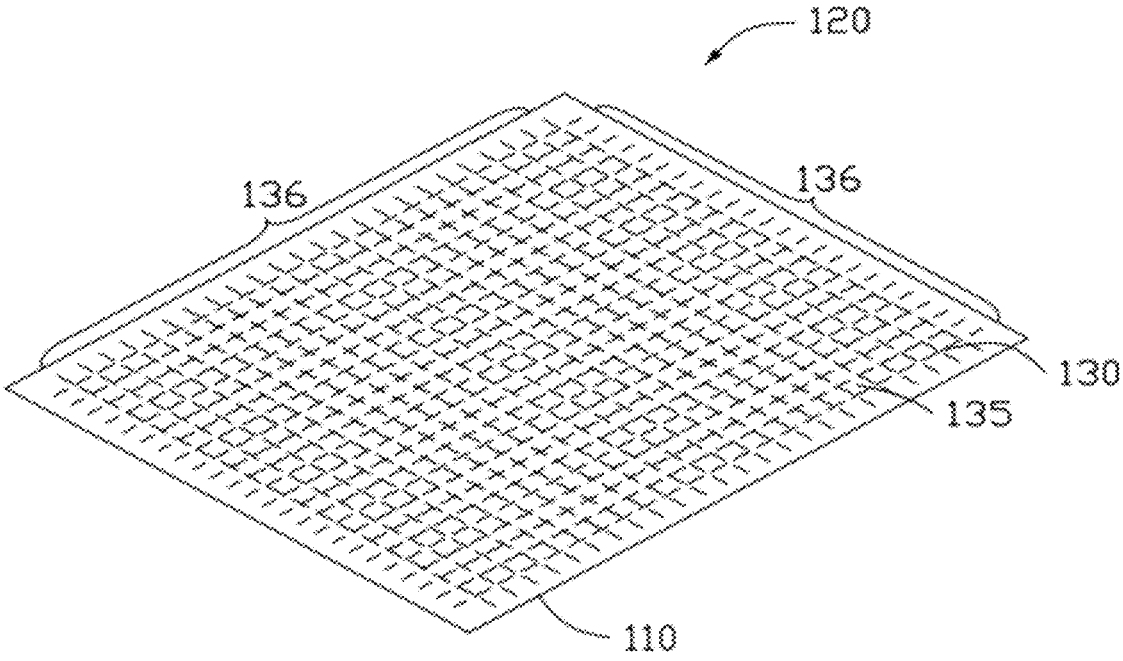
FIG. 6 is a schematic view of one embodiment of a graphene/carbon nanotube composite structure.
Figure 7:
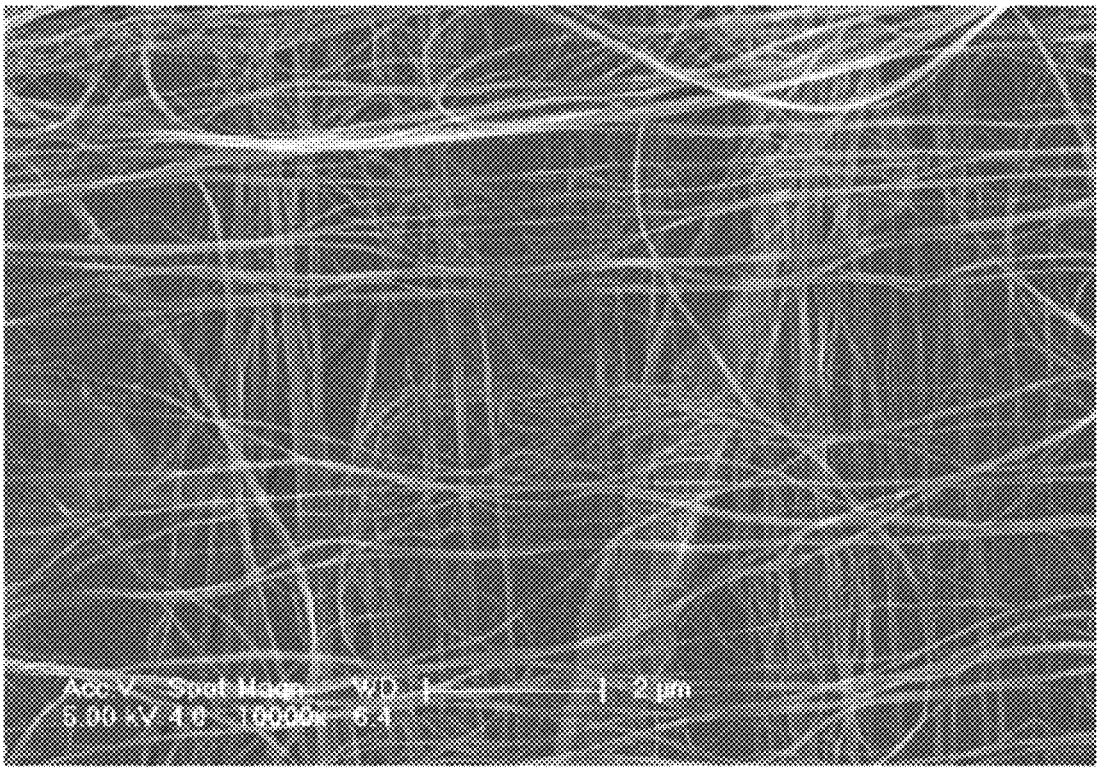
FIG. 7 is an SEM image of a graphene/carbon nanotube composite structure.
Figure 8:
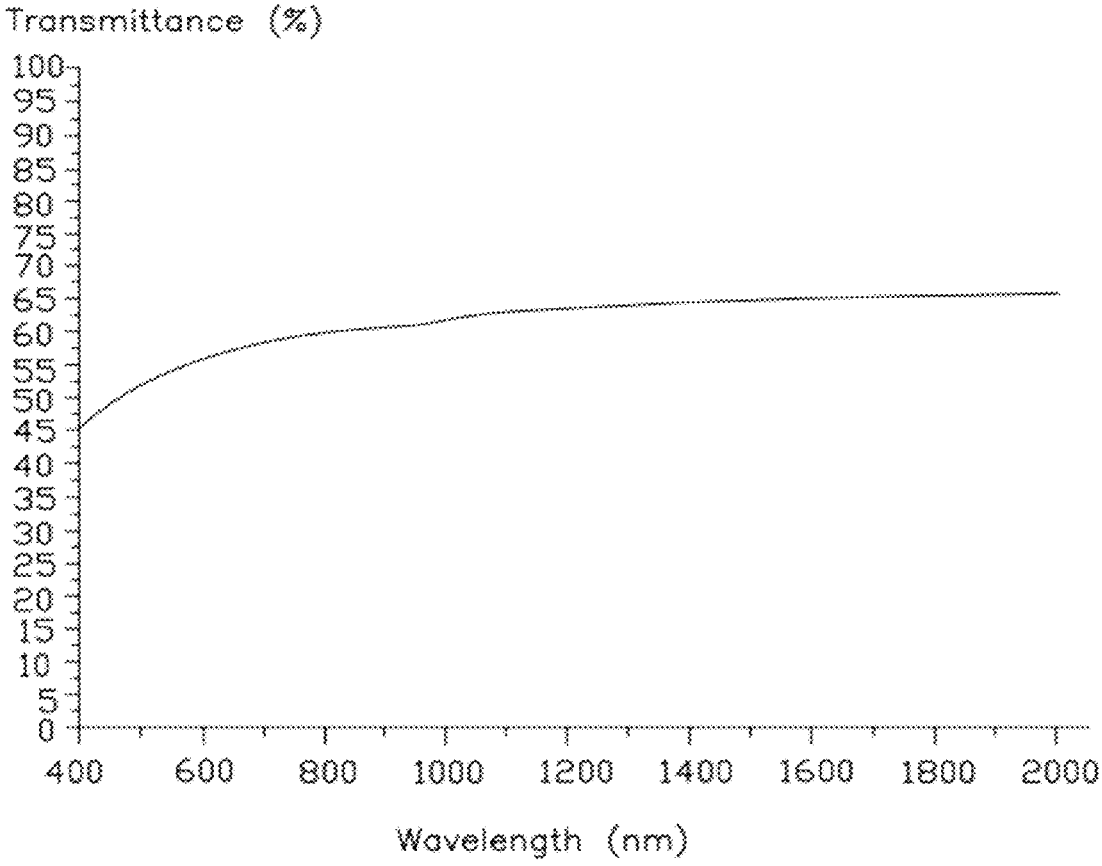
FIG. 8 shows a transparence graph of the graphene/carbon nanotube composite structure in FIG. 7.

In one embodiment according to FIGS. 6 and 7, the sound wave generator 102 is a graphene/carbon nanotube composite structure 120 consisting of a carbon nanotube film structure 130 and a graphene film 110 located on a surface of the carbon nanotube film structure 130. The carbon nanotube film structure 130 includes a plurality of micropores 135. The graphene film 110 can cover all of the plurality of micropores 135. The carbon nanotube film structure 130 consists of at least two two stacked drawn carbon nanotube films. The angle between the alignment directions of the carbon nanotubes in two adjacent drawn carbon nanotube films is about 90 degrees. The graphene film is a single layer of graphene (the chapped layer). Referring to FIG. 8, a transmittance of visible light of the graphene/carbon nanotube composite structure is greater than 60%. The thermoacoustic device 10 using the graphene/carbon nanotube composite structure as the sound wave generator 102 can be a transparent device.

The graphene film 110 is very compact, but has low strength. The carbon nanotube film structure 130 has high strength and includes micropores. The graphene/carbon nanotube composite structure including the carbon nanotube film structure 130 and the graphene film 110 has the advantage of being compact and having a high strength. If the graphene/carbon nanotube composite structure is used as the sound wave generator 102, because the graphene film 110 covers the micropores in the carbon nanotube film structure 130, and the graphene/carbon nanotube composite structure has a larger contacting area with the surrounding medium, the sound wave generator has a high efficiency. The thickness of the carbon nanotube film structure 130 and the graphene film 110 can be very thin, and a thickness and a heat capacity of the graphene/carbon nanotube composite structure can be minimal, thus the sound wave generator has a good sound effect and high sensitivity.

In one embodiment, the graphene film 110 can be grown on surface of a metal substrate by a chemical vapor deposition (CVD) method. Therefore, the graphene film 110 is a whole sheet structure having a flat planar shape located on the metal substrate having an area greater than 2 square centimeters ($cm^2$). In one embodiment, the graphene film 110 is a square film with an area of 4 cm×4 cm.

Figure 9:
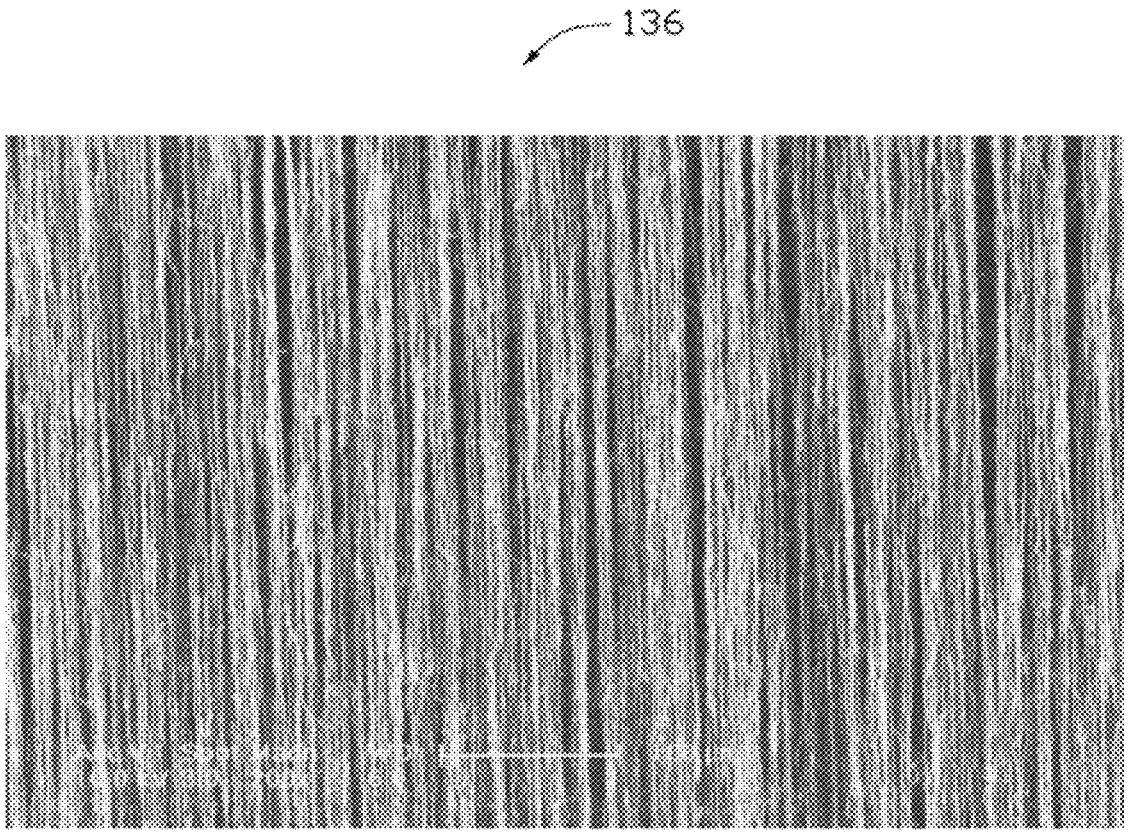
FIG. 9 is a Scanning Electron Microscopic (SEM) image of a drawn carbon nanotube film.

Referring to FIG. 9, the drawn carbon nanotube film 136 includes a number of successive and oriented carbon nanotubes joined end-to-end by van der Waals attractive force therebetween. The drawn carbon nanotube film 136 can have a large specific surface area (e.g., above 100 $m^2/g$). The drawn carbon nanotube film 136 is a freestanding film. Each drawn carbon nanotube film 136 includes a number of successively oriented carbon nanotube segments joined end-to-end by van der Waals attractive force therebetween. Each carbon nanotube segment includes a number of carbon nanotubes substantially parallel to each other, and joined by van der Waals attractive force therebetween. Some variations can occur in the drawn carbon nanotube film. The carbon nanotubes in the drawn carbon nanotube film 136 are oriented along a preferred orientation. The drawn carbon nanotube film 136 can be treated with an organic solvent to increase the mechanical strength and toughness of the drawn carbon nanotube film 136 and reduce the coefficient of friction of the drawn carbon nanotube film 136. The thickness of the drawn carbon nanotube film 136 can range from about 0.5 nanometers to about 100 micrometers. The drawn carbon nanotube film 136 can be used as a carbon nanotube film structure 130.

The carbon nanotubes in the drawn carbon nanotube film 136 can be single-walled, double-walled, or multi-walled carbon nanotubes. The diameters of the single-walled carbon nanotubes can range from about 0.5 nanometers to about 50 nanometers. The diameters of the double-walled carbon nanotubes can range from about 1 nanometer to about 50 nanometers. The diameters of the multi-walled carbon nanotubes can range from about 1.5 nanometers to about 50 nanometers. The lengths of the carbon nanotubes can range from about 200 micrometers to about 900 micrometers.

The carbon nanotube film structure 130 can include at least two stacked drawn carbon nanotube films 136. The carbon nanotubes in the drawn carbon nanotube film 136 are aligned along one preferred orientation. An angle can exist between the orientations of carbon nanotubes in adjacent drawn carbon nanotube films 136, whether stacked or adjacent. An angle between the aligned directions of the carbon nanotubes in two adjacent drawn carbon nanotube films 136 can range from about 0 degrees to about 90 degrees (e.g. about 15 degrees, 45 degrees or 60 degrees).

Figure 10:
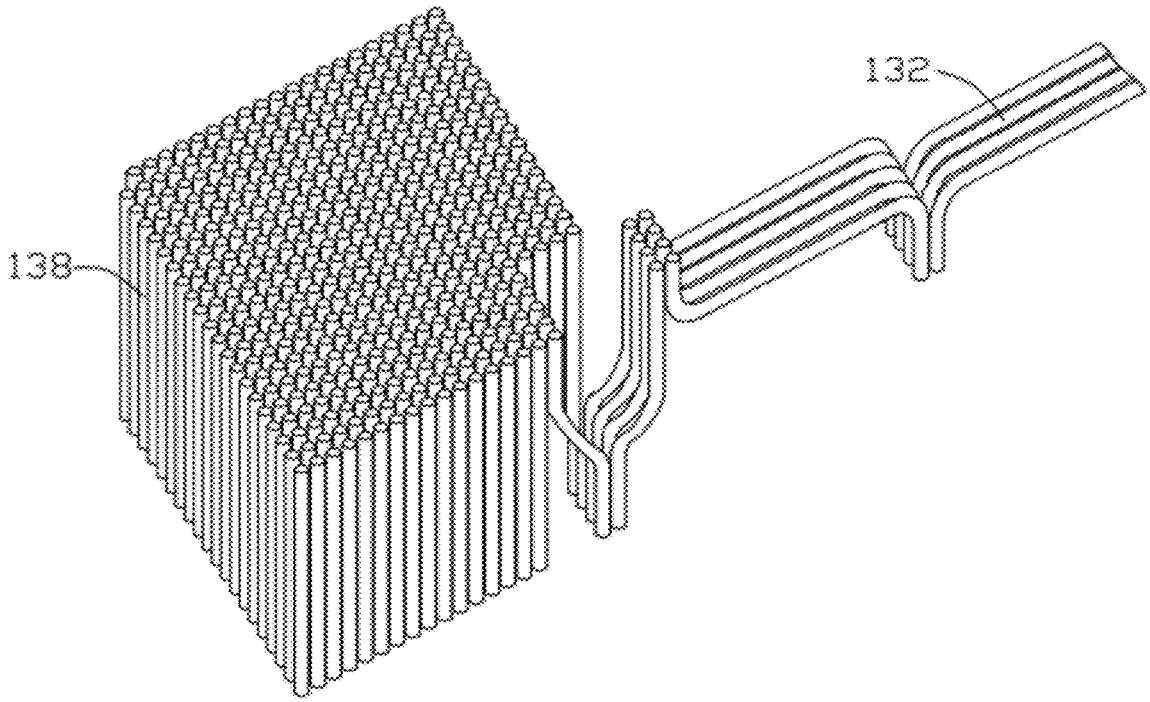
FIG. 10 is a schematic view of one embodiment of a method of making the drawn carbon nanotube film in FIG. 9.

Referring to FIG. 10, the drawn carbon nanotube film 136 can be formed by drawing a film from a carbon nanotube array 138 using a pulling/drawing tool.

Figure 11:
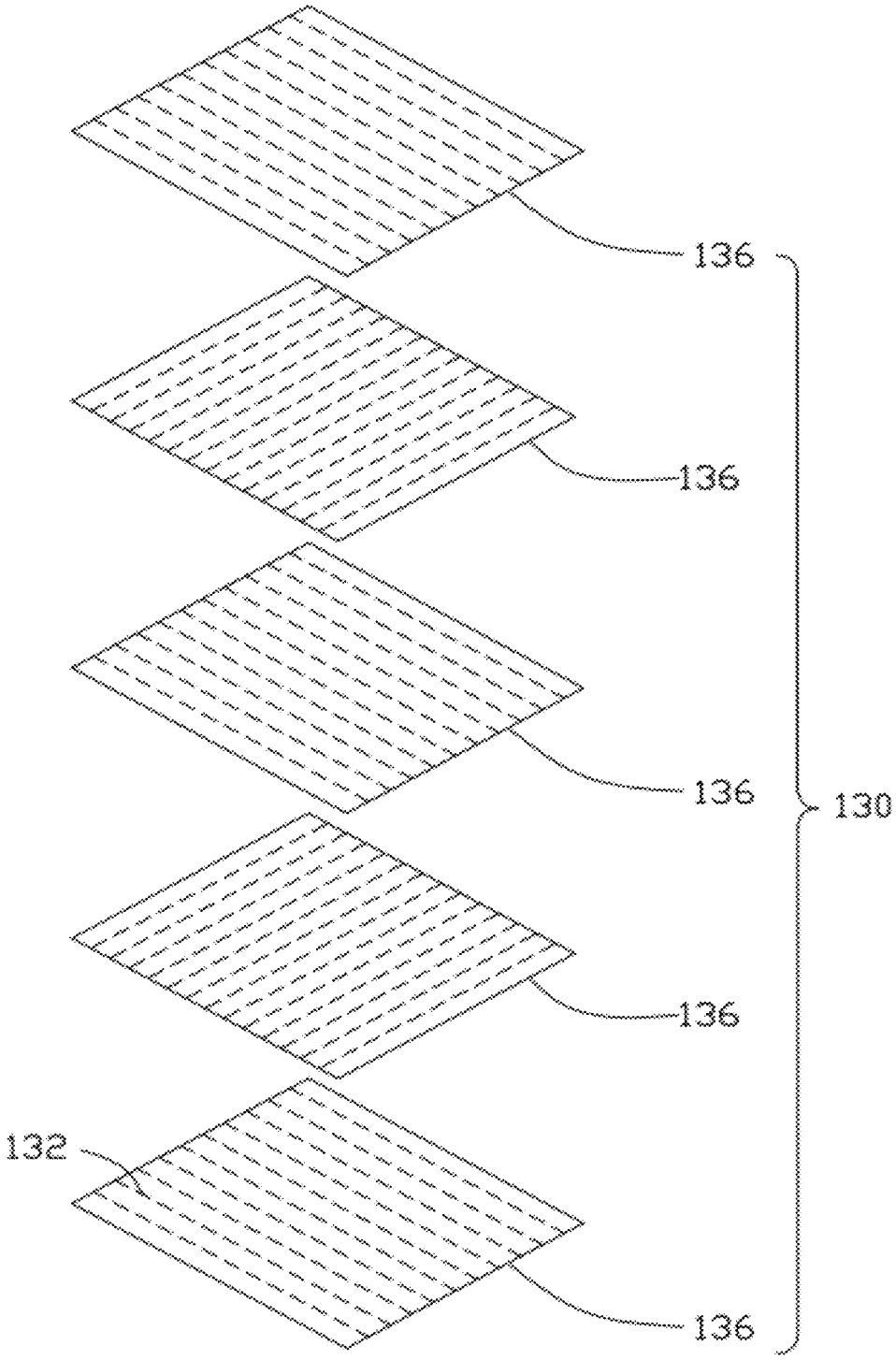
FIG. 11 is an exploded view of one embodiment of a carbon nanotube film structure shown with five stacked drawn carbon nanotube films

Referring to FIG. 11, in one embodiment, the carbon nanotube film structure 130 includes five drawn carbon nanotube films 136 crossed and stacked with each other. An angle between the adjacent drawn carbon nanotube films 136 is not limited.

Figure 12:
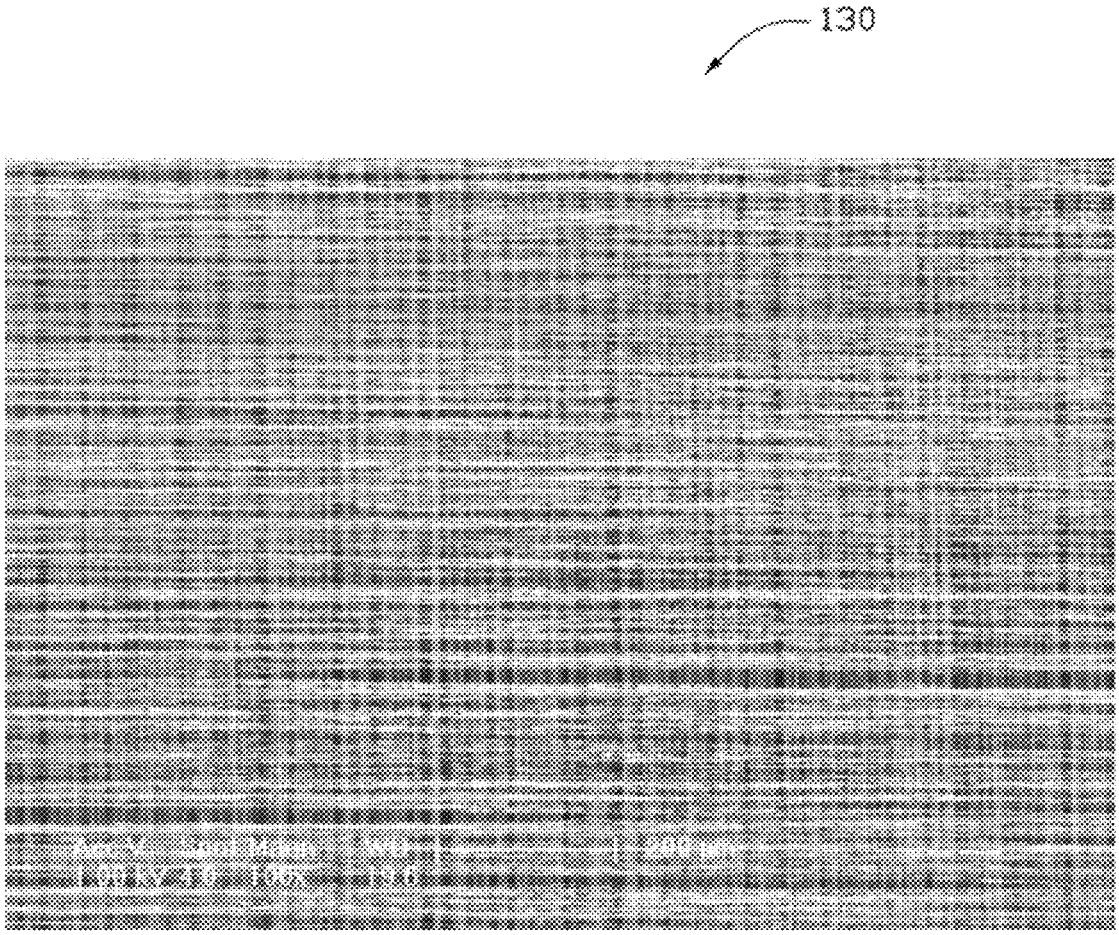
FIG. 12 is an SEM image of one embodiment of a carbon nanotube structure.

For example, two or more such drawn carbon nanotube films 136 can be stacked on each other on the frame to form a carbon nanotube film structure 130. An angle between the alignment axes of the carbon nanotubes in every two adjacent drawn carbon nanotube films 136 is not limited. Referring to FIG. 11 and FIG. 12, in one embodiment, the angle between the alignment axes of the carbon nanotubes in every two adjacent drawn carbon nanotube films 136 is about 90 degrees. The carbon nanotubes in every two adjacent drawn carbon nanotube films 136 are crossing each other, thereby forming a carbon nanotube film structure 130 with a microporous structure.

Figure 13:
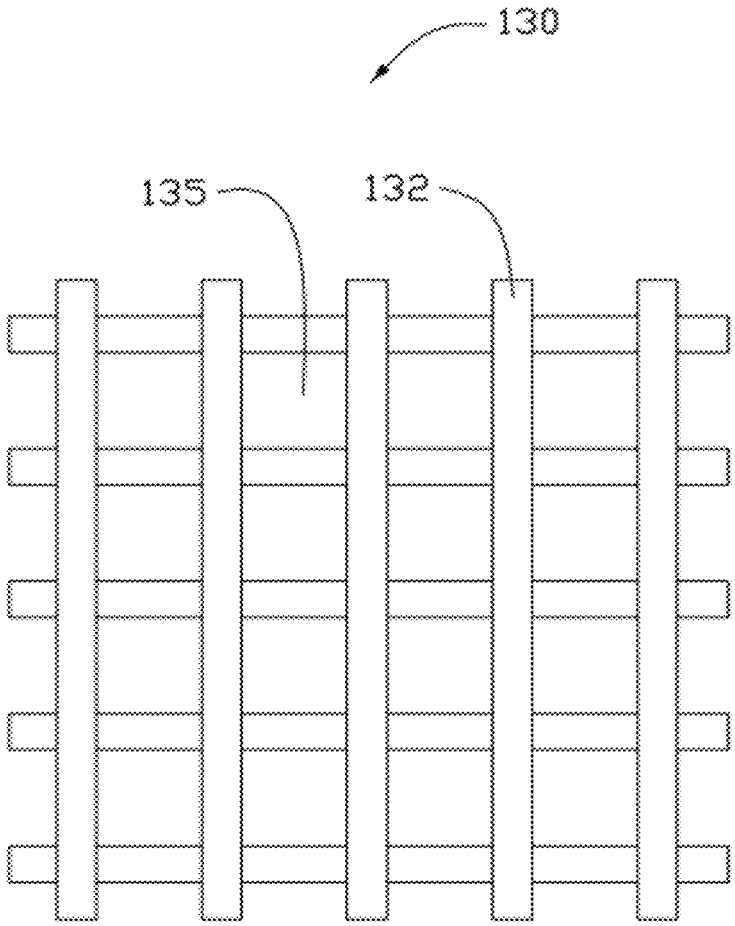
FIG. 13 is a schematic view of an enlarged part of the carbon nanotube film structure in FIG. 12.

Referring to FIG. 13, because the drawn carbon nanotube film 136 includes a plurality of stripped gaps between the carbon nanotube segments 132 (as can be seen in FIG. 9), the stripped gaps of the adjacent drawn carbon nanotube films 136 can cross each other thereby forming a plurality of micropores 135 in the carbon nanotube film structure 130. A width of the stripped gaps is in a range from about 1 micrometer to about 10 micrometers. An average dimension of the plurality of micropores 135 is in a range from about 1 micrometer to about 10 micrometers. In one embodiment, the average dimension of the plurality of micropores 135 is greater than 5 micrometers. The graphene film 110 covers all of the plurality of micropores 135 of the carbon nanotube film structure 130.

To increase the dimension of the micropores 135 in the carbon nanotube film structure 130, the carbon nanotube film structure 130 can be treated with an organic solvent.

After being soaked by the organic solvent, the carbon nanotube segments 132 in the drawn carbon nanotube film 136 of the carbon nanotube film structure 130 can at least partially shrink and collect or bundle together.

Figure 14:
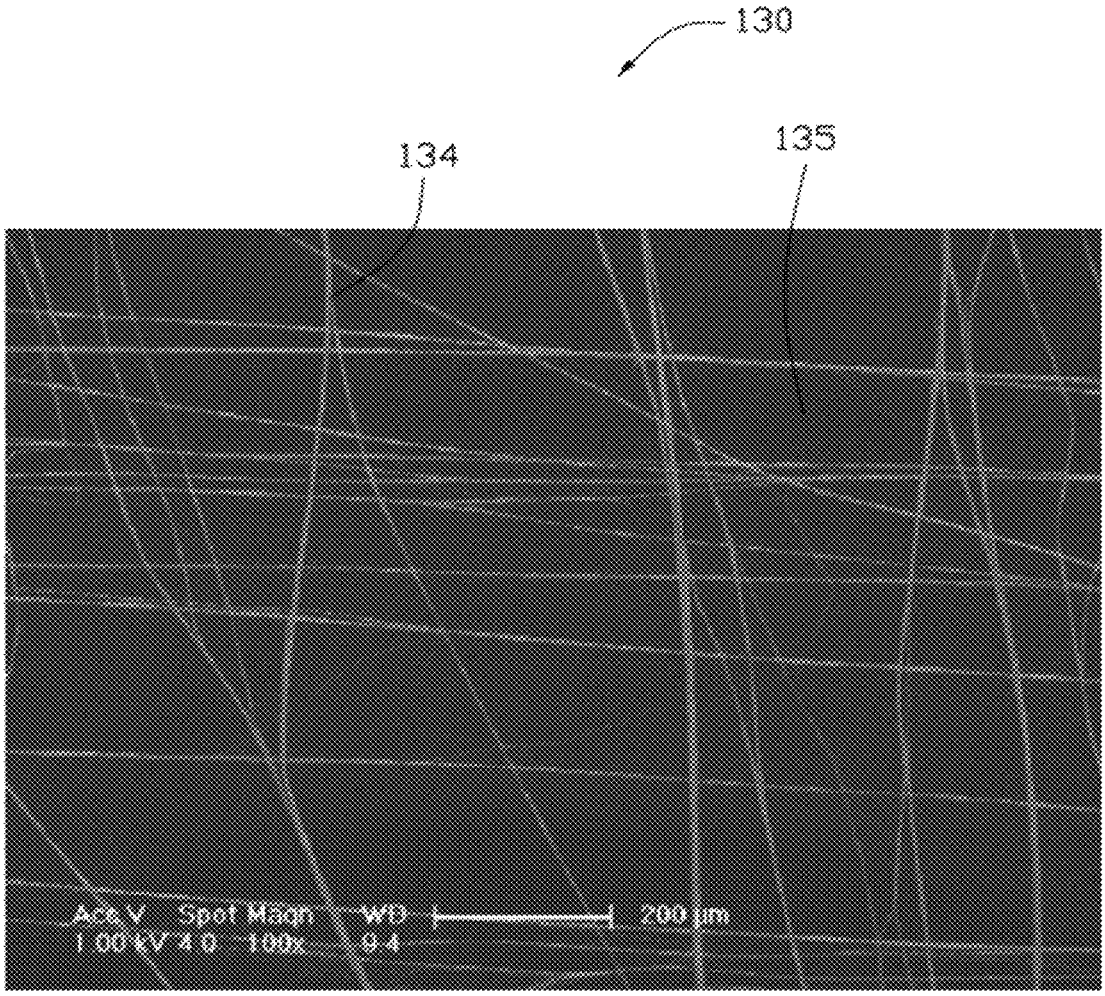
FIG. 14 is an SEM image of a carbon nanotube structure treated by a solvent.

Referring to FIG. 13 and FIG. 14, the carbon nanotube segments 132 in the drawn carbon nanotube film 136 of the carbon nanotube film structure 130 are joined end to end and aligned along a same direction. Thus the carbon nanotube segments 132 would shrink in a direction substantially perpendicular to the orientation of the carbon nanotube segments 132. If the drawn carbon nanotube film 136 is fixed on a frame or a surface of a supporter or a substrate, the carbon nanotube segments 132 would shrink into several large bundles or carbon nanotube strips 134. A distance between the adjacent carbon nanotube strips 134 is greater than the width of the gaps between the carbon nanotube segments 132 of the drawn carbon nanotube film 136. Referring to FIG. 14, due to the shrinking of the adjacent carbon nanotube segments 132 into the carbon nanotube strips 134, the parallel carbon nanotube strips 134 are relatively distant (especially compared to the initial layout of the carbon nanotube segments) to each other in one layer and cross with the parallel carbon nanotube strips 134 in each adjacent layer. A distance between the adjacent carbon nanotube strips 134 is in a range from about 10 micrometers to about 1000 micrometers. As such, the dimension of the micropores 135 is increased and can be in a range from about 10 micrometers to about 1000 micrometers. Due to the decrease of the specific surface via bundling, the coefficient of friction of the carbon nanotube film structure 130 is reduced, but the carbon nanotube film structure 130 maintains its high mechanical strength and toughness. A ratio of an area of the plurality of micropores of the carbon nanotube film structure 130 is in a range from about 10:11 to about 1000:1001.

The organic solvent is volatilizable and can be ethanol, methanol, acetone, dichloroethane, chloroform, or any combinations thereof.

To increase the dimension of the micropores 135 in the carbon nanotube film structure 130, the drawn carbon nanotube films 136 can be treated with a laser beam before stacking upon each other to form the carbon nanotube film structure 130.

The laser beam treating method includes fixing the drawn carbon nanotube film 136 and moving the laser beam at an even/uniform speed to irradiate the drawn carbon nanotube film 136, thereby forming a plurality of carbon nanotube strips 134. A laser device used in this process can have a power density greater than $0.1\times10^4$ W/m$^2$.

The laser beam is moved along a direction in which the carbon nanotubes are oriented. The carbon nanotubes absorb energy from laser irradiation and the temperature thereof is increased. Some of the carbon nanotubes in the drawn carbon nanotube film 136 will absorb excess energy and be destroyed. When the carbon nanotubes along the orientation of the carbon nanotubes in the drawn carbon nanotube film 136 are destroyed from absorbing excess laser irradiation energy, a plurality of carbon nanotube strips 134 is formed substantially parallel with each other. A distance between the adjacent carbon nanotube strips 134 is in a range from about 10 micrometers to about 1000 micrometers. A gap between the adjacent carbon nanotube strips 134 is in a range from about 10 micrometers to about 1000 micrometers. A width of the plurality of carbon nanotube strips 134 can be in a range from about 100 nanometers to about 10 micrometers.

Figure 15:
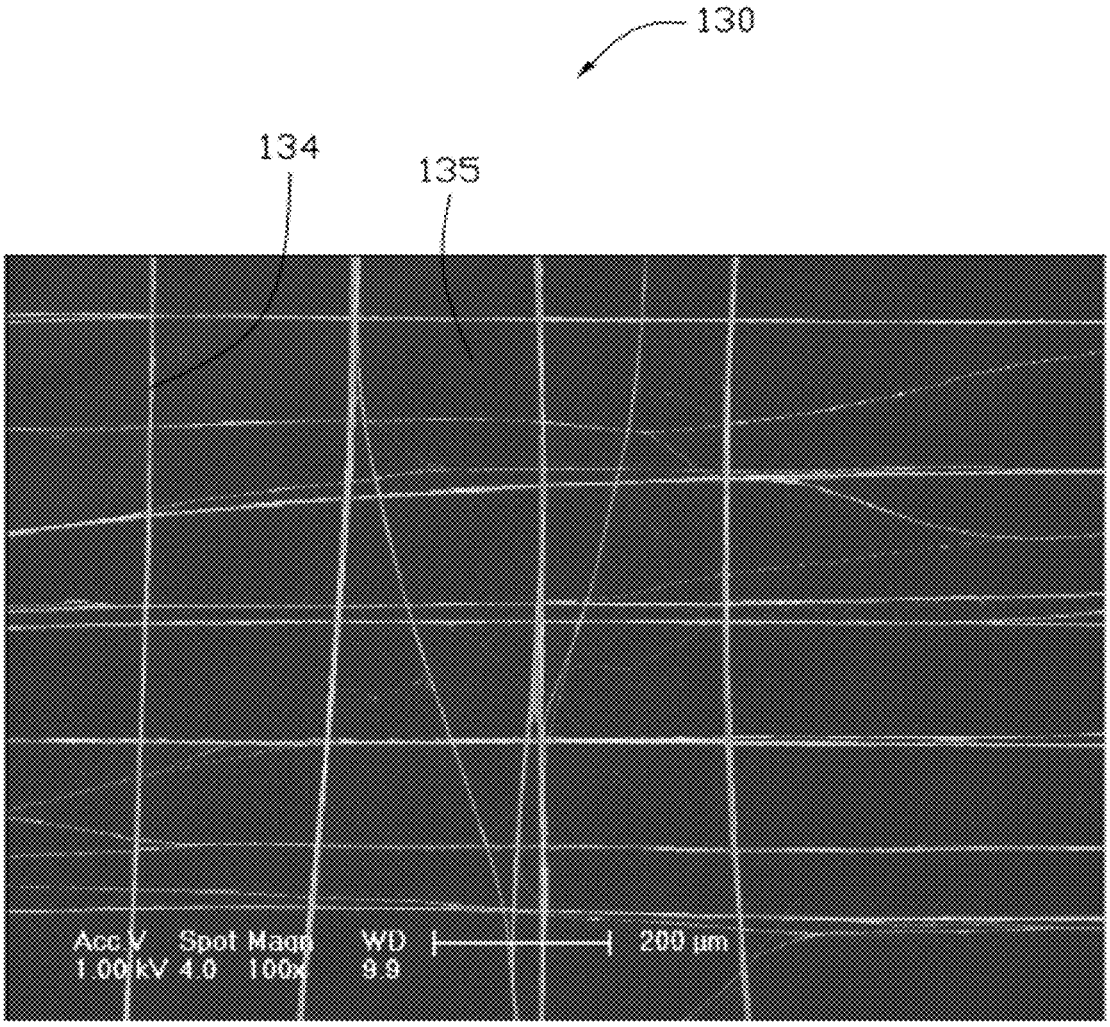
FIG. 15 is an SEM image of a carbon nanotube structure made by drawn carbon nanotube films treated by a laser.

Referring to FIG. 15, in one embodiment, a carbon nanotube film structure 130 is formed by stacking two laser treated drawn carbon nanotube films 136. The carbon nanotube film structure 130 includes a plurality of carbon nanotube strips 134 crossed with each other and forming a plurality of micropores 135. An average dimension of the micropores is in a range from about 200 micrometers to about 400 micrometers.

The carbon nanotube film structure 130 can be put on the graphene film 110 and cover the graphene film 110. The carbon nanotube film structure 130 and the graphene film 110 can be stacked on top of each other by mechanical force. A polymer solution can be located on the graphene film 110 before putting the at least one carbon nanotube film structure 130 on the graphene film 110 to help combine the carbon nanotube film structure 130 and the graphene film 110.

The polymer solution can be formed by dissolving a polymer material in an organic solution. In one embodiment, the viscosity of the solution is greater than 1 Pa-s. The polymer material can be a solid at room temperature, and can be transparent. The polymer material can be polystyrene, polyethylene, polycarbonate, polymethyl methacrylate (PMMA), polycarbonate (PC), terephthalate (PET), benzo cyclo butene (BCB), or polyalkenamer. The organic solution can be ethanol, methanol, acetone, dichloroethane or chloroform. In one embodiment, the polymer material is PMMA, and the organic solution is ethanol.

Because the drawn carbon nanotube film 136 has a good adhesive property, the plurality of drawn carbon nanotube films 136 can be directly located on the graphene film 110 step by step and crossed with each other. Therefore, the carbon nanotube film structure 130 is formed directly on the graphene film 110. Furthermore, an organic solvent can be dropped on the carbon nanotube film structure 130 to increase the dimension of the microspores 135 in the carbon nanotube film structure 130.

The graphene/carbon nanotube composite structure 120 can include two graphene films 110 separately located on two opposite surfaces of the carbon nanotube film structure 130.

Figure 16:
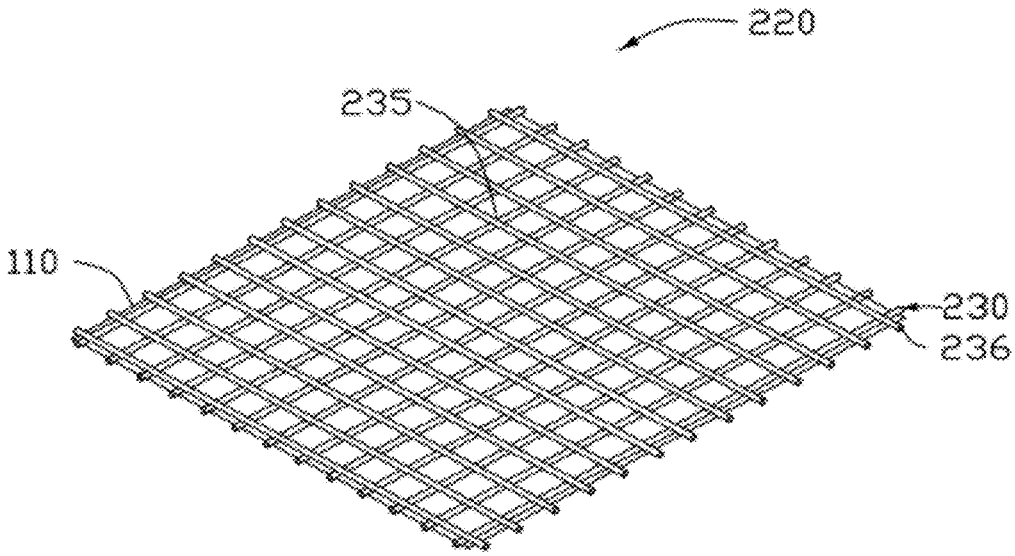
FIG. 16 is a schematic view of another embodiment of a graphene/carbon nanotube composite structure.

Referring to FIG. 16, in another embodiment, a graphene/carbon nanotube composite structure 220 includes a carbon nanotube film structure 230 and a graphene film 110 located on a surface of the carbon nanotube film structure 230.

The carbon nanotube film structure 230 includes a plurality of carbon nanotube wires 236 crossed with each other thereby forming a network. The carbon nanotube film structure 230 includes a plurality of micropores 235. In one embodiment, the plurality of carbon nanotube wires 236 is divided into two parts. The first parts of the plurality of carbon nanotube wires 236 are substantially parallel to and spaced with each other, and a first gap is formed between the adjacent first parts of the plurality of carbon nanotube wires 236. The second parts of the plurality of carbon nanotube wires 236 are substantially parallel to and spaced with each other, and a second gap is formed between the adjacent second parts of the plurality of carbon nanotube wires 236. A width of the first or the second parts of the plurality of carbon nanotube wires 236 is in a range from about 10 micrometers to about 1000 micrometers.

The first and the second parts of the plurality of carbon nanotube wires 236 are crossed with each other, and an angle is formed between the first and the second parts of the plurality of carbon nanotube wires 236. In one embodiment, the angle between the axes of the first and the second parts of the plurality of carbon nanotube wires 236 is about 90 degrees. A diameter of the plurality of micropores 235 can be in a range from about 10 micrometers to about 1000 micrometers.

The carbon nanotube wires 236 can be twisted carbon nanotube wires, or untwisted carbon nanotube wires.

Figure 17:
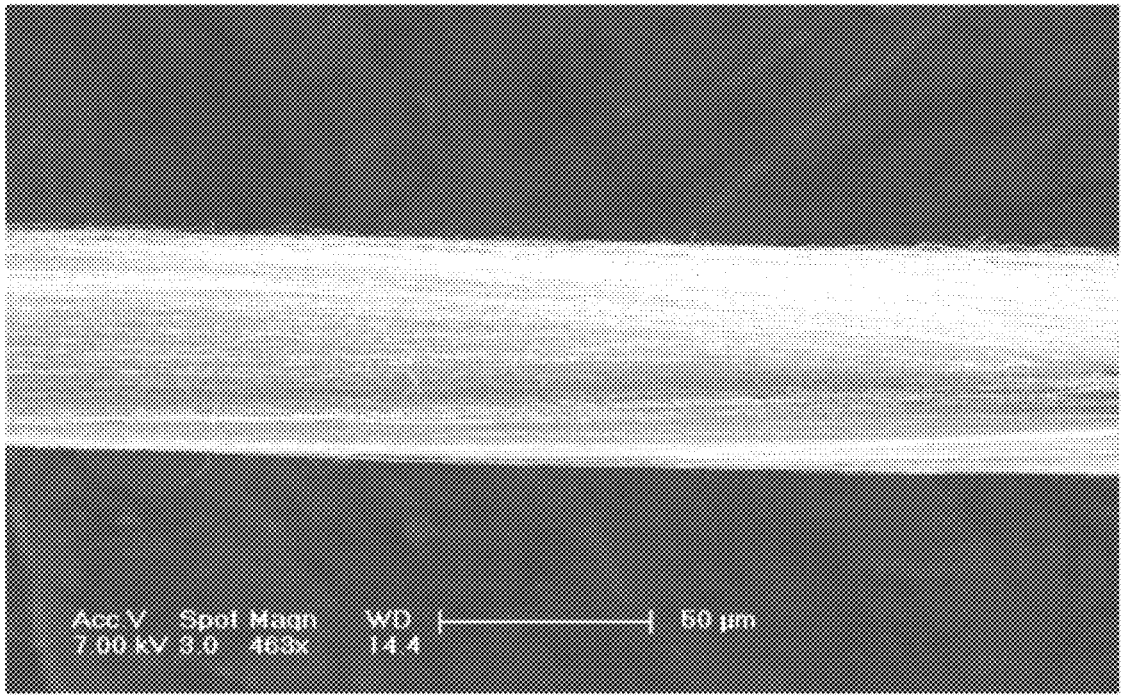
FIG. 17 is an SEM image of an untwisted carbon nanotube wire.

The untwisted carbon nanotube wire can be formed by treating the drawn carbon nanotube film 136 with a volatile organic solvent. Specifically, the drawn carbon nanotube film 136 is treated by applying the organic solvent to the drawn carbon nanotube film 136 to soak the entire surface of the drawn carbon nanotube film 136. After being soaked by the organic solvent, the adjacent paralleled carbon nanotubes in the drawn carbon nanotube film 136 will bundle together, due to the surface tension of the organic solvent as the organic solvent volatilizesg, and thus, the drawn carbon nanotube film 136 will be shrunk into untwisted carbon nanotube wire. Referring to FIG. 17, the untwisted carbon nanotube wire includes a plurality of carbon nanotubes substantially oriented along a same direction (e.g., a direction along the length of the untwisted carbon nanotube wire). The carbon nanotubes are substantially parallel to the axis of the untwisted carbon nanotube wire. The length of the untwisted carbon nanotube wire can be set as desired. The diameter of an untwisted carbon nanotube wire can range from about 1 micrometer nanometers to about 10 micrometers. In one embodiment, the diameter of the untwisted carbon nanotube wire is about 5 micrometers. Examples of the untwisted carbon nanotube wire is taught by US Patent Application Publication US 2007/0166223 to Jiang et al.

Figure 18:
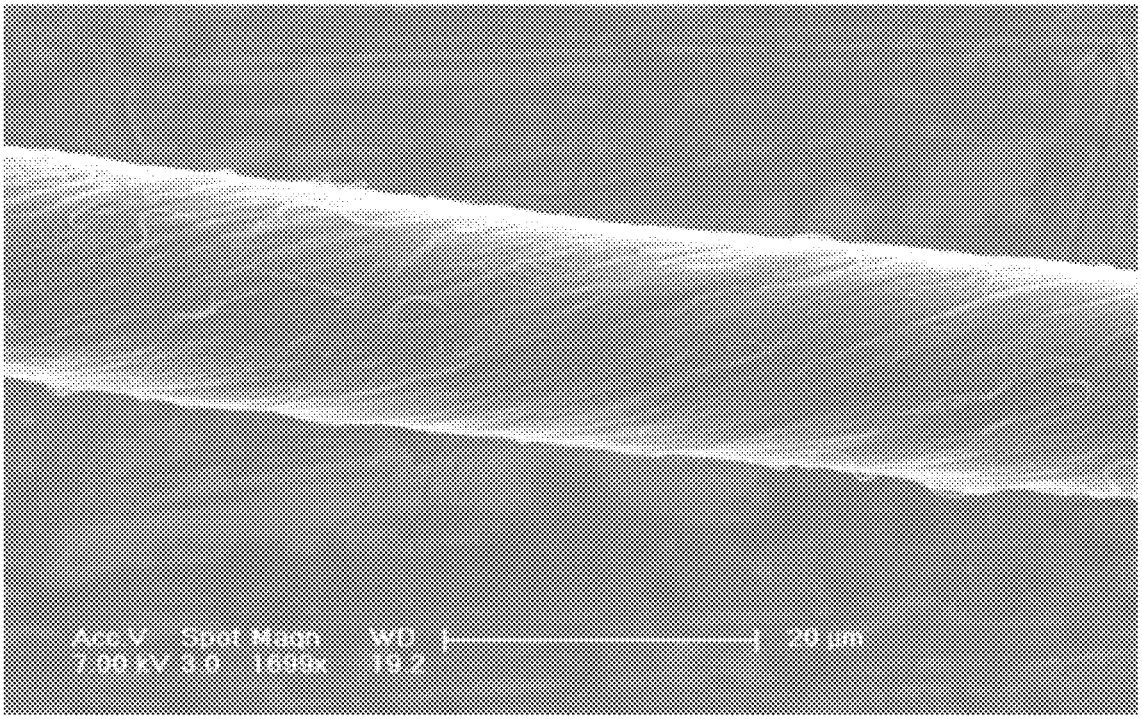
FIG. 18 is an SEM image of a twisted carbon nanotube wire.

The twisted carbon nanotube wire can be formed by twisting a drawn carbon nanotube film 136 by using a mechanical force to turn the two ends of the drawn carbon nanotube film 136 in opposite directions. Referring to FIG. 18, the twisted carbon nanotube wire includes a plurality of carbon nanotubes oriented around an axial direction of the twisted carbon nanotube wire. The carbon nanotubes are aligned around the axis of the carbon nanotube twisted wire like a helix. The length of the carbon nanotube wire can be set as desired. The diameter of the twisted carbon nanotube wire can range from about 0.5 nanometers to about 100 micrometers. Further, the twisted carbon nanotube wire can be treated with a volatile organic solvent, before or after being twisted. After being soaked by the organic solvent, the adjacent paralleled carbon nanotubes in the twisted carbon nanotube wire will bundle together. The specific surface area of the twisted carbon nanotube wire will decrease. The density and strength of the twisted carbon nanotube wire will be increased. The twisted and untwisted carbon nanotube cables can be produced by methods that are similar to the methods of making twisted and untwisted carbon nanotube wires.

The thermoacoustic device 10 has a wide frequency response range and a high sound pressure level. The sound pressure level of the sound waves generated by the thermoacoustic device 10 can be greater than 50 dB. The frequency response range of the thermoacoustic device 10 can be from about 1 Hz to about 100 KHz with a power input of 4.5 W. The total harmonic distortion of the thermoacoustic device 10 is extremely small, e.g., less than 3% in a range from about 500 Hz to 40 KHz. The thermoacoustic device 10 can be used in many apparatus, such as, telephone, Mp3, Mp4, TV, computer. Further, because the thermoacoustic device 10 can be transparent, it can be stuck on a screen directly.

Energy Generator

The signal input device 104 is used to input signals into the sound wave generator. The signals can be electrical signals, optical signals or electromagnetic wave signals. With variations in the application of the signals and/or strength applied to the sound wave generator 102, the sound wave generator 102 according to the variations of the signals and/or signal strength produces repeated heating. Temperature waves propagated into surrounding medium are obtained. The surrounding medium is not limited, as long as a resistance of the surround medium is larger than a resistance of the sound wave generator 102. The surrounding medium can be air, water, or organic liquid. The temperature waves produce pressure waves in the surrounding medium, resulting in sound generation. In this process, it is the thermal expansion and contraction of the medium in the vicinity of the sound wave generator 102 that produces sound. This is distinct from the mechanism of the conventional loudspeaker, in which the mechanical movement of the diaphragm creates the pressure waves.

In the embodiment according to FIGS. 1 and 2, the signal input device 104 includes a first electrode 104*a* and a second electrode 104*b*. The first electrode 104*a* and the second electrode 104*b* are electrically connected with the sound wave generator 102 and input electrical signals to the sound wave generator 102. The sound wave generator 102 can produce joule heat. The first electrode 104*a* and the second electrode 104*b* are made of conductive material. The shape of the first electrode 104*a* or the second electrode 104*b* is not limited and can be lamellar, rod, wire, and block among other shapes. A material of the first electrode 104*a* or the second electrode 104*b* can be metals, conductive adhesives, carbon nanotubes, and indium tin oxides among other conductive materials. The first electrode 104*a* and the second electrode 104*b* can be metal wire or conductive material layers, such as metal layers formed by a sputtering method, or conductive paste layers formed by a method of screen-printing.

In some embodiments, the first electrode 104*a* and the second electrode 104*b* can be a linear carbon nanotube structure. The linear carbon nanotube structure includes a plurality of carbon nanotubes joined end to end. The plurality of carbon nanotubes is parallel with each other and oriented along an axial direction of the linear carbon nanotube structure. In one embodiment, the linear carbon nanotube structure is a pure structure consisting of the plurality of carbon nanotubes.

The first electrode 104*a* and the second electrode 104*b* can be electrically connected to two terminals of an electrical signal input device (such as a MP3 player) by a conductive wire. The first electrode 104*a* and the second electrode 104*b* can be substantially parallel with each other. If the carbon nanotube film structure 130 includes a plurality of carbon nanotubes oriented in a same direction, the direction can be parallel with the first electrode 104*a* and the second electrode 104*b*. That is to say, the carbon nanotubes are oriented from the first electrode 104*a* to the second electrode 104*b*. Thus, electrical signals output from the electrical signal device can be inputted into the sound wave generator 102 through the first and second electrodes 104*a*, 104*b*. In one embodiment, the sound wave generator 102 is a drawn carbon nanotube film 136 drawn from the carbon nanotube array 138, and the carbon nanotubes in the carbon nanotube film are aligned along a direction from the first electrode 104*a* to the second electrode 104*b*. The first electrode 104*a* and the second electrode 104*b* can both have a length greater than or equal to the drawn carbon nanotube film 136 width.

A conductive adhesive layer can be further provided between the first and second electrodes 104*a*, 104*b* and the sound wave generator 102. The conductive adhesive layer can be applied to a surface of the sound wave generator 102. The conductive adhesive layer can be used to provide better electrical contact and attachment between the first and second electrodes 104*a*, 104*b* and the sound wave generator 102.

The first electrode 104*a* and the second electrode 104*b* can be used to support the sound wave generator 102. In one embodiment, the first electrode 104*a* and the second electrode 104*b* are fixed on a frame, and the sound wave generator 102 is supported by the first electrode 104*a* and the second electrode 104*b*.

Figure 27:
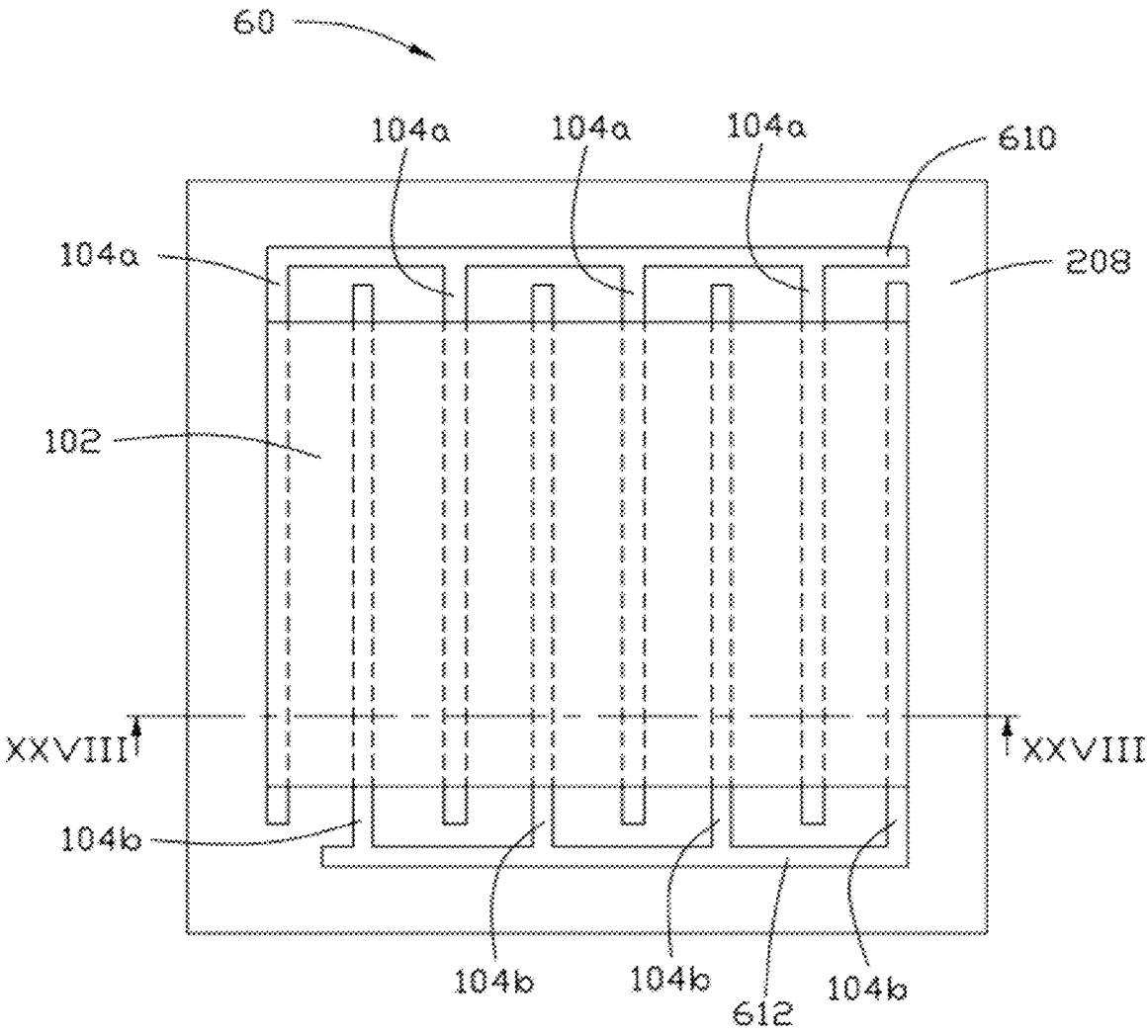
FIG. 27 is a schematic top plan view of one embodiment of a thermoacoustic device.
Figure 28:
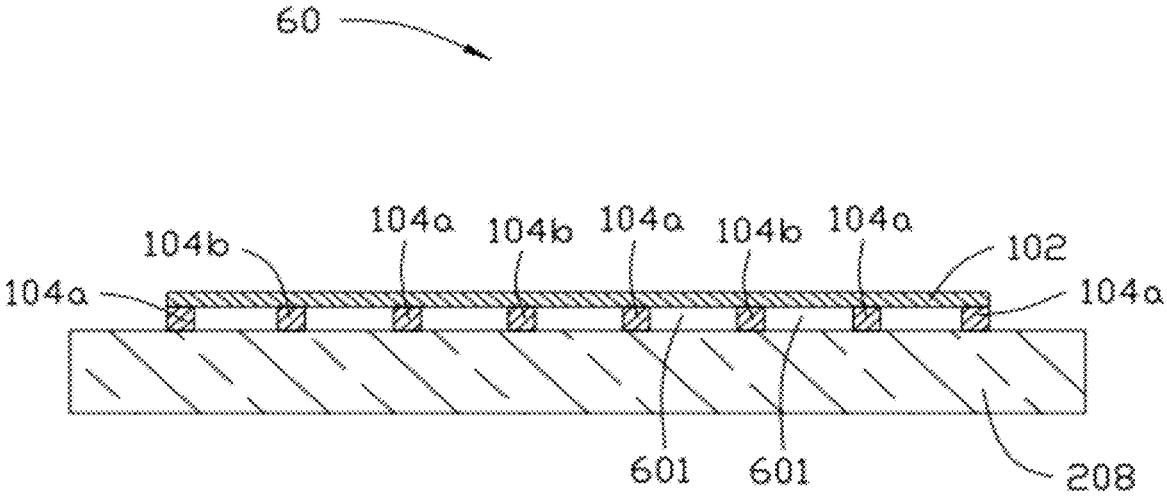
FIG. 28 is a cross-sectional view taken along a line XXVIII-XXVIII of the thermoacoustic device in FIG. 27.

In one embodiment according to FIGS. 27 and 28, a thermoacoustic device 60 can include a plurality of alternating first and second electrodes 104*a*, 104*b*. The first electrodes 104*a* and the second electrodes 104*b* can be arranged alternating in a staggered manner. All the first electrodes 104*a* are electrically connected together, and all the second electrodes 104*b* are electrically connected together. The sections of the sound wave generator 102 between the adjacent first electrode 104*a* and the second electrode 104*b* are in parallel. An electrical signal is conducted in the sound wave generator 102 from the first electrodes 104*a* to the second electrodes 104*b*. By placing the sections in parallel, the resistance of the thermoacoustic device 60 is decreased. Therefore, the driving voltage of the thermoacoustic device 60 can be decreased with the same effect.

The first electrodes 104*a* and the second electrodes 104*b* can be substantially parallel to each other with a same distance between the adjacent first electrode 104*a* and the second electrode 104*b*. In some embodiments, the distance between the adjacent first electrode 104*a* and the second electrode 104*b* can be in a range from about 1 millimeter to about 3 centimeters.

To connect all the first electrodes 104*a* together, and connect all the second electrodes 104*b* together, a first conducting member 610 and a second conducting member 612 can be arranged. All the first electrodes 104*a* are connected to the first conducting member 610. All the second electrodes 104*b* are connected to the second conducting member 612.

The first conducting member 610 and the second conducting member 612 can be made of the same material as the first and second electrodes 104*a*, 104*b*, and can be substantially perpendicular to the first and second electrodes 104*a*, 104*b*.

Referring to FIG. 28, the sound wave generator 102 is supported by the first electrode 104*a* and the second electrode 104*b*.

Substrate

Referring to FIGS. 27 and 28, the thermoacoustic device 60 can further include a substrate 208, and the sound wave generator 102 can be disposed on the substrate 208. The shape, thickness, and size of the substrate 208 are not limited. A top surface of the substrate 208 can be planar or curvy. A material of the substrate 208 is not limited, and can be a rigid or a flexible material. The resistance of the substrate 208 is greater than the resistance of the sound wave generator 102 to avoid a short circuit through the substrate 208. The substrate 208 can have a good thermal insulating property, thereby preventing the substrate 208 from absorbing the heat generated by the sound wave generator 102. The material of the substrate 208 can be selected from suitable materials including, plastics, ceramics, diamond, quartz, glass, resin and wood. In one embodiment according to FIGS. 27 and 28, the substrate 208 is a glass square board with a thickness of about 20 millimeters and a length of each side of the substrate 208 of about 17 centimeters. In the embodiment according to FIG. 28, the sound wave generator 102 is suspended above the top surface of the substrate 208 via the plurality of first electrodes 104*a* and the second electrode 104*b*. The plurality of first electrodes 104*a* and the second electrodes 104*b* are located between the sound wave generator 102 and the substrate 208. Part of the sound wave generator 102 is suspended in air via the first, second electrodes 104*a*, 104*b*. A plurality of interval spaces 601 is defined by the substrate 208, the surface wave generator 102 and adjacent electrodes. Thus, the sound wave generator 102 can have greater contact and heat exchange with the surrounding medium.

Because the graphene film 110 and the carbon nanotube film structure 130 both have large specific surface areas and can be naturally adhesive, the sound wave generator 102 can also be adhesive. Therefore, the sound wave generator 102 can directly adhere to the top surface of the substrate 208 or the first, second electrodes 104*a*, 104*b*. If the sound wave generator 102 is the graphene/carbon nanotube composite structure 120 including at least one carbon nanotube film structure 130 and at least one graphene film 110, the at least one carbon nanotube film structure 130 can directly contact with the surface of the substrate 208 or the first, second electrodes 104*a*, 104*b*. Alternatively, the at least one graphene film 110 can directly contact with the surface of the substrate 208 or the first, second electrodes 104*a*, 104*b*.

In other embodiment, the sound wave generator 102 can be directly located on the top surface of the substrate 208, and the first, second electrodes 104*a*, 104*b* are located on the sound wave generator. The sound wave generator 102 is located between the first, second electrodes 104*a*, 104*b* and the substrate 208. The substrate 208 can further define at least one recess through the top surface. By provision of the recess, part of the sound wave generator 102 can be suspended in air via the recess. Therefore, the part of the sound wave generator 102 above the recess has better contact and heat exchange with the surrounding medium. Thus, the electrical-sound transforming efficiency of the thermoacoustic device 10 can be greater than when the entire sound wave generator 102 is in contact with the top surface of the substrate 208. An opening defined by the recess at the top surface of the substrate 208 can be rectangular, polygon, flat circular, I-shaped, or any other shape. The substrate 208 can define a number of recesses through the top surface. The recesses can be substantially parallel to each other. According to different materials of the substrate 208, the recesses can be formed by mechanical methods or chemical methods, such as cutting, burnishing, or etching. A mold with a predetermined shape can also be used to define the recesses on the substrate 208.

Figure 19:
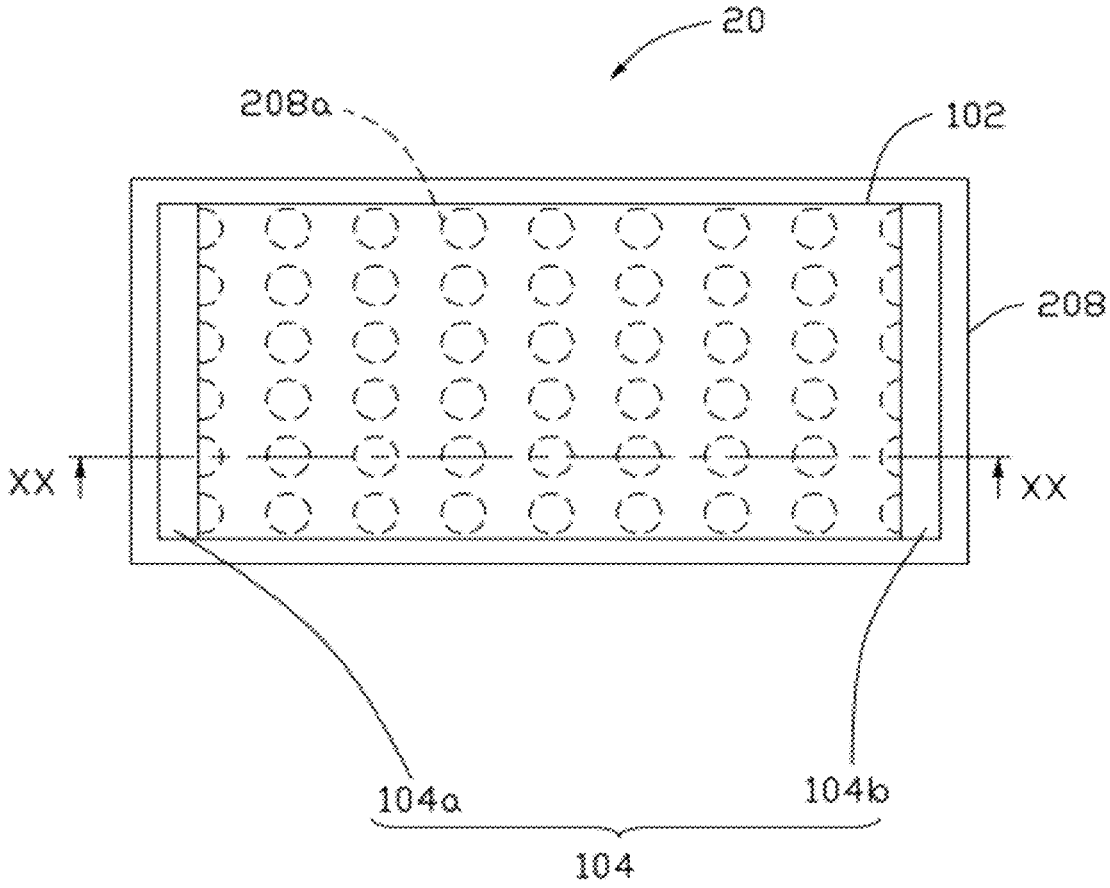
FIG. 19 is a schematic top plan view of one embodiment of a thermoacoustic device.
Figure 20:
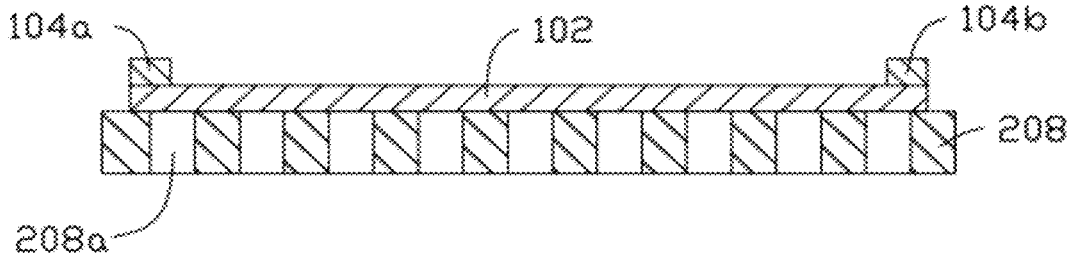
FIG. 20 is a cross-sectional view taken along a line XX-XX of the thermoacoustic device in FIG. 19.

Referring to FIGS. 19 and 20, in one embodiment of a thermoacoustic device 20, each recess 208*a* is a round through hole. The diameter of the through hole can be about 0.5 μm. A distance between two adjacent recesses 208*a* can be larger than 100 μm. An opening defined by the recess 208*a* at the top surface of the substrate 208 can be round. The opening defined by the recess 208*a* can also have be rectangular, triangle, polygon, flat circular, I-shaped, or any other shape.

Figure 21:
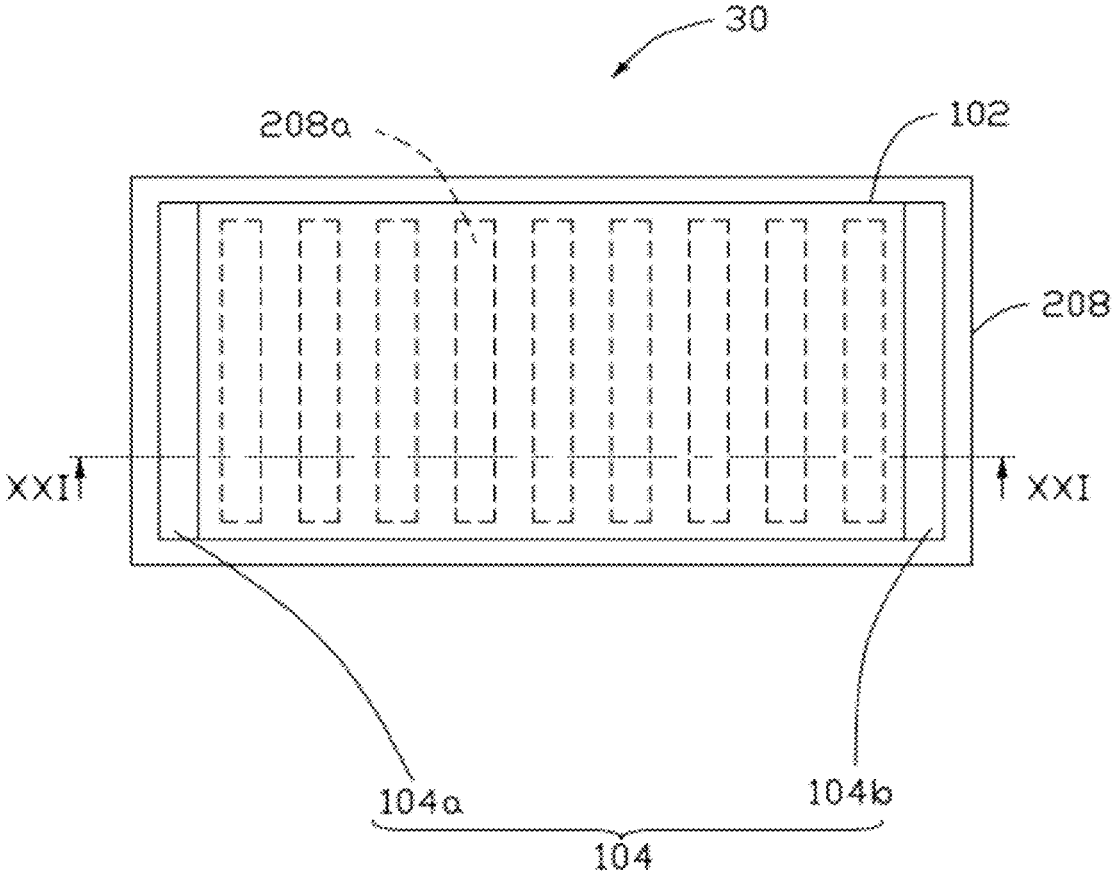
FIG. 21 is a schematic top plan view of one embodiment of a thermoacoustic device.
Figure 22:
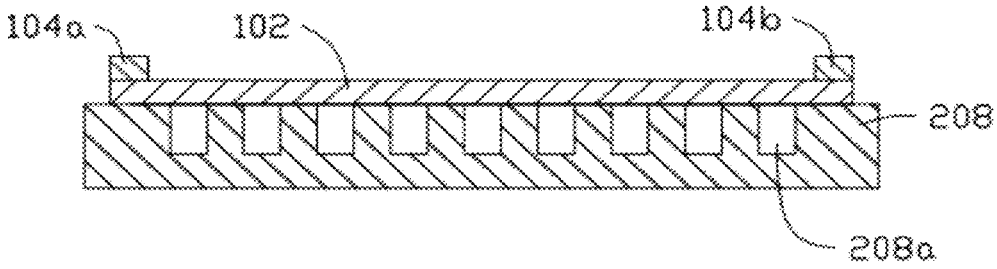
FIG. 22 is a cross-sectional view taken along a line XXII-XXII of the thermoacoustic device in FIG. 21 according to one example.
Figure 23:
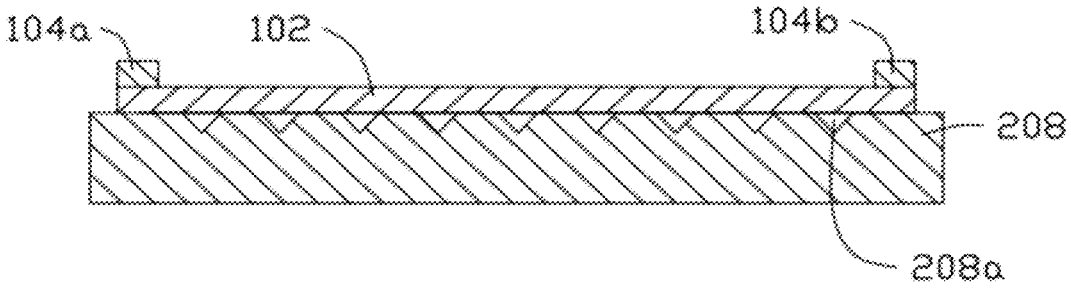
FIG. 23 is a cross-sectional view taken along a line XXIII-XXIII of the thermoacoustic device in FIG. 21 according to another example.

In one embodiment of a thermoacoustic device 30 according to FIG. 21, each recess 208*a* is a groove. The groove can be blind or through. In the embodiment of FIG. 22, the substrate 208 includes a plurality of blind grooves having square strip shaped openings on the top surface of the substrate 208. In the embodiment of FIG. 23, the substrate 208 includes a plurality of blind grooves having rectangular strip shaped openings. The blind grooves can be parallel to each other and located apart from each other for the same distance.

Figure 24:
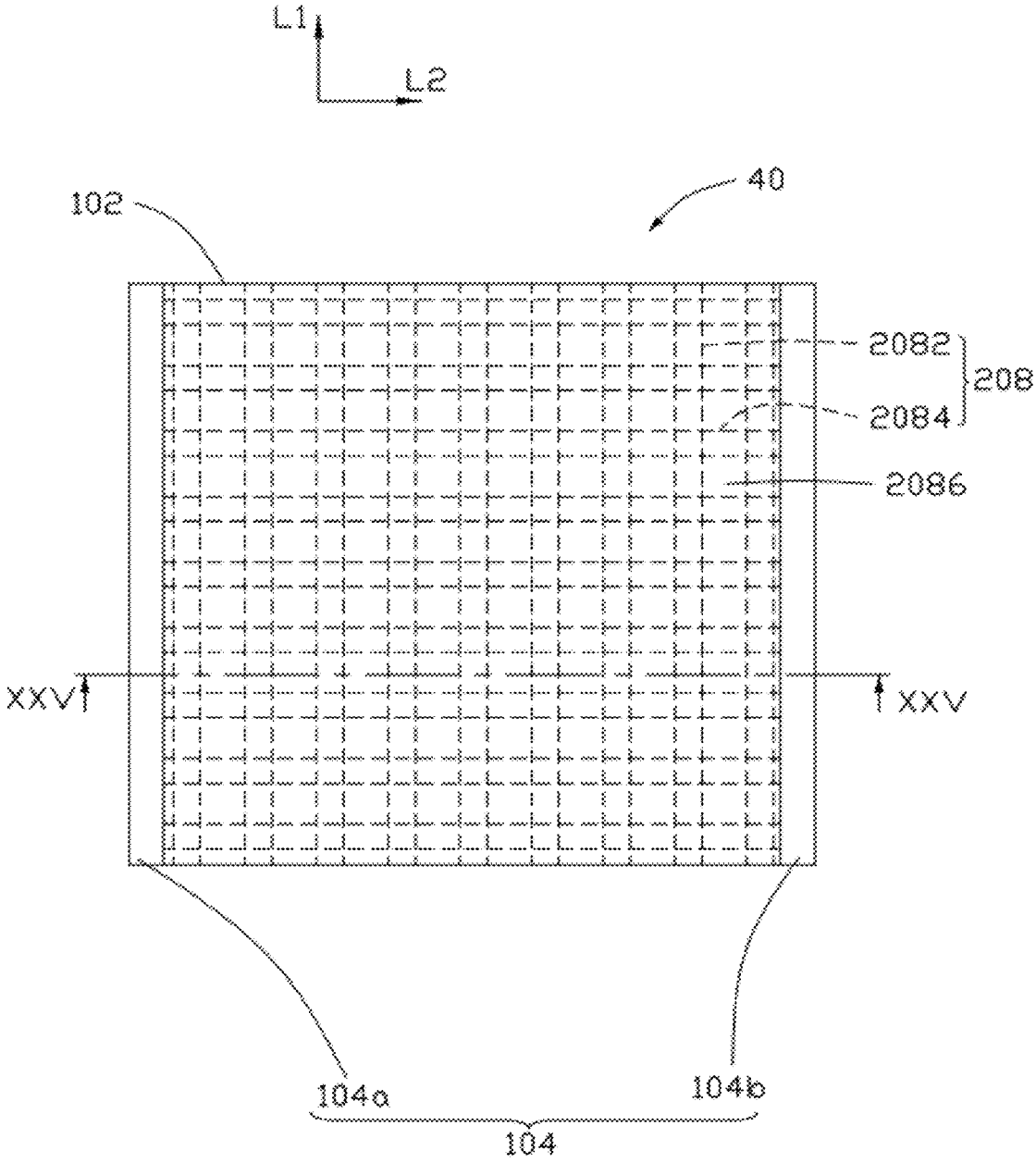
FIG. 24 is a schematic top plan view of one embodiment of a thermoacoustic device.
Figure 25:
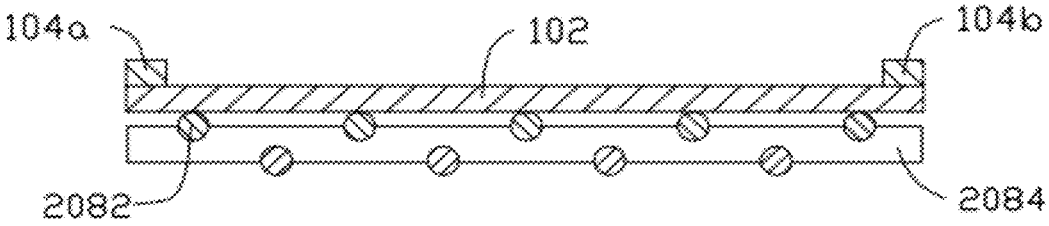
FIG. 25 is a cross-sectional view taken along a line XXV-XXV of the thermoacoustic device in FIG. 24.

Referring to FIG. 24, in one embodiment of a thermoacoustic device 40, the substrate 208 has a net structure. The net structure includes a plurality of first wires 2082 and a plurality of second wires 2084. The plurality of first wires 2082 and the plurality of second wires 2084 cross each other to form a net-structured substrate 208. The plurality of first wires 2082 is oriented along a direction of L1 and disposed apart from each other. The plurality of second wires 2084 is oriented along a direction of L2 and disposed apart from each other. An angle α defined between the direction L1 and the direction L2 is in a range from about 0 degrees to about 90 degrees. In one embodiment, according to FIG. 24, the direction L1 is substantially perpendicular with the direction L2, e.g. α is about 90 degrees. The first wires 2082 can be located on the same side of the second wires 2084. In the intersections between the first wires 2082 and the second wires 2084, the first wires 2082 and the second wires 2084 are fixed by adhesive or jointing method. If the first wires 2082 have a low melting point, the first wires 2082 and the second wires 2084 can join with each other by a heat-pressing method. In one embodiment according to FIG. 25, the plurality of first wires 2082 and the plurality of second wires 2084 are weaved together to form the substrate 208 having the net structure, and the substrate 208 is an intertexture. On any one of the first wires 2082, two adjacent second wires 2084 are disposed on two opposite sides of the first wire 2082. On any one of the second wires 2084, two adjacent first wires 2082 are disposed on two opposite sides of the second wire 2084.

The first wires 2082 and the second wires 2084 can define a plurality of meshes 2086. Each mesh 2086 has a quadrangle shape. According to the angle between the orientation direction of the first wires 2082 and the second wires 2084 and distance between adjacent first, second wires 2082, 2084, the meshes 2086 can be square, rectangle or rhombus.

The diameters of the first wires 2082 can be in a range from about 10 microns to about 5 millimeters. The first wires 2082 and the second wires 2084 can be made of insulated materials, such as fiber, plastic, resin, and silica gel. The fiber includes plant fiber, animal fiber, wood fiber, and mineral fiber. The first wires 2082 and the second wires 2084 can be cotton wires, twine, wool, or nylon wires. Particularly, the insulated material can be flexible and refractory. Furthermore, the first wires 2082 and the second wire 2084 can be made of conductive materials coated with insulated materials. The conductive materials can be metal, alloy or carbon nanotube.

In one embodiment, at least one of the first wire 2082 and the second wire 2084 is made of a composite wire including a carbon nanotube wire structure and a coating layer wrapping the carbon nanotube wire structure. A material of the coating layer can be insulative. The insulative materials can be plastic, rubber or silica gel. A thickness of the coating layer can be in a range from about 1 nanometer to about 10 micrometers.

The carbon nanotube wire structure includes a plurality of carbon nanotubes joined end to end. The carbon nanotube wire structure can be a substantially pure structure of carbon nanotubes, with few or no impurities. The carbon nanotube wire structure can be a freestanding structure. The carbon nanotubes in the carbon nanotube wire structure can be single-walled, double-walled, or multi-walled carbon nanotubes. A diameter of the carbon nanotube wire structure can be in a range from about 10 nanometers to about 1 micrometer.

The carbon nanotube wire structure includes at least one carbon nanotube wire. The carbon nanotube wire includes a plurality of carbon nanotubes. The carbon nanotube wire can be a wire structure of pure carbon nanotubes. The carbon nanotube wire structure can include a plurality of carbon nanotube wires substantially parallel with each other. In other embodiments, the carbon nanotube wire structure can include a plurality of carbon nanotube wires twisted with each other.

The carbon nanotube wire can be untwisted or twisted. Referring to FIG. 17, the untwisted carbon nanotube wire includes a plurality of carbon nanotubes substantially oriented along a same direction (i.e., a direction along the length direction of the untwisted carbon nanotube wire). The untwisted carbon nanotube wire can be a pure structure of carbon nanotubes. The untwisted carbon nanotube wire can be a freestanding structure. The carbon nanotubes are substantially parallel to the axis of the untwisted carbon nanotube wire. In one embodiment, the untwisted carbon nanotube wire includes a plurality of successive carbon nanotube segments joined end to end by van der Waals attractive force therebetween. Each carbon nanotube segment includes a plurality of carbon nanotubes substantially parallel to each other, and combined by van der Waals attractive force therebetween. The carbon nanotube segments can vary in width, thickness, uniformity and shape. The length of the untwisted carbon nanotube wire can be arbitrarily set as desired. A diameter of the untwisted carbon nanotube wire ranges from about 50 nanometers to about 100 micrometers.

Referring to FIG. 18, the twisted carbon nanotube wire includes a plurality of carbon nanotubes helically oriented around an axial direction of the twisted carbon nanotube wire. The twisted carbon nanotube wire can be a pure structure of carbon nanotubes. The twisted carbon nanotube wire can be a freestanding structure. In one embodiment, the twisted carbon nanotube wire includes a plurality of successive carbon nanotube segments joined end to end by van der Waals attractive force therebetween. Each carbon nanotube segment includes a plurality of carbon nanotubes substantially parallel to each other, and combined by van der Waals attractive force therebetween. The length of the carbon nanotube wire can be set as desired. A diameter of the twisted carbon nanotube wire can be from about 50 nanometers to about 100 micrometers.

In one embodiment, the first wire 2082 and the second wire 2084 are both composite wires. The composite wire consists of a single carbon nanotube wire and the coating layer.

The substrate 208 having net structure has the following advantages. The substrate 208 includes a plurality of meshes, therefore, the sound wave generator 102 located on the substrate 208 can have a large contact area with the surrounding medium. If the first wire 2082 or the second wire 2084 is made of the composite wire, because the carbon nanotube wire structure can have a small diameter, the diameter of the composite wire can have a small diameter, thus the contact area between the sound wave generator and the surrounding medium can be further increased. The net structure can have good flexibility, and the thermoacoustic device 10 can be flexible.

Figure 26:
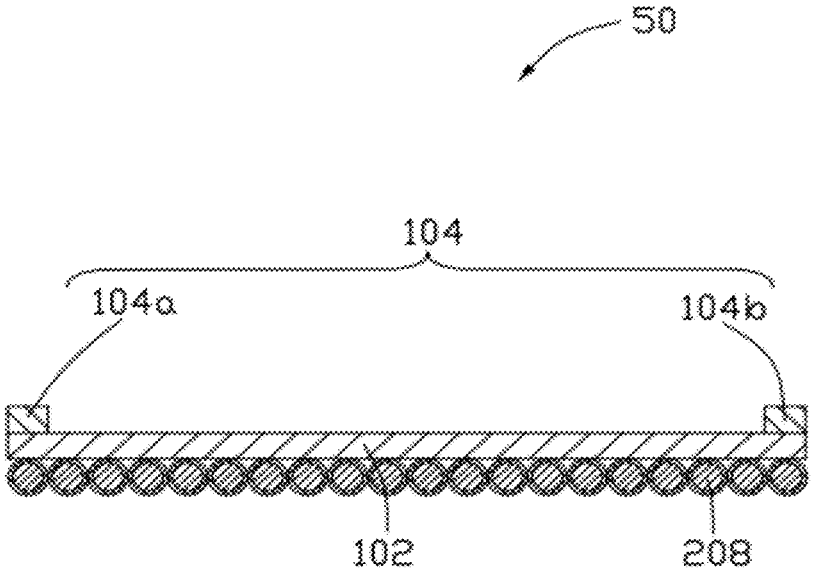
FIG. 26 is a schematic cross-sectional view of one embodiment of a thermoacoustic device including a carbon nanotube composite structure used as a substrate.

Referring to FIG. 26, in a thermoacoustic device 50 according to one embodiment, the substrate 208 can be a carbon nanotube composite structure. The carbon nanotube composite structure includes the carbon nanotube structure and a matrix. The matrix insulates the carbon nanotube structure from the sound wave generator 102. The matrix is located on surface of the carbon nanotube structure. In one embodiment, the matrix wraps the carbon nanotube structure, the carbon nanotube structure is embedded in the matrix. In another embodiment, the matrix is located between the carbon nanotube structure and the sound wave generator 102. In another embodiment, the matrix is coated on each carbon nanotubes in the carbon nanotube film structure 130, and the carbon nanotube composite structure includes a number of pores defined by adjacent carbon nanotubes coated by the matrix. The size of the pores is less than 5 micrometers. A thickness of the matrix can be in a range from about 1 nanometer to about 100 nanometers. A material of the matrix can be insulative, such as plastic, rubber, or silica gel. The characteristics of the carbon nanotube composite structure are the same as the carbon nanotube film structure 130.

The carbon nanotube composite structure can have good flexibility, and the thermoacoustic device 10 using the carbon nanotube composite structure as the substrate 208 can be flexible. If the carbon nanotube composite structure includes the number of pores, the sound wave generator 102 disposed on the carbon nanotube composite structure can have a large contacting surface with the surrounding medium.

Spacers

The sound wave generator 102 can be disposed on or separated from the substrate 208. To separate the sound wave generator 102 from the substrate 208, the thermoacoustic device can further include one or some spacers. The spacer is located on the substrate 208, and the sound wave generator 102 is located on and partially supported by the spacer. An interval space is defined between the sound wave generator 102 and the substrate 208. Thus, the sound wave generator 102 can be sufficiently exposed to the surrounding medium and transmit heat into the surrounding medium. Therefore, the efficiency of the thermoacoustic device can be greater than having the entire sound wave generator 102 contacting the top surface of the substrate 208.

Figure 29:
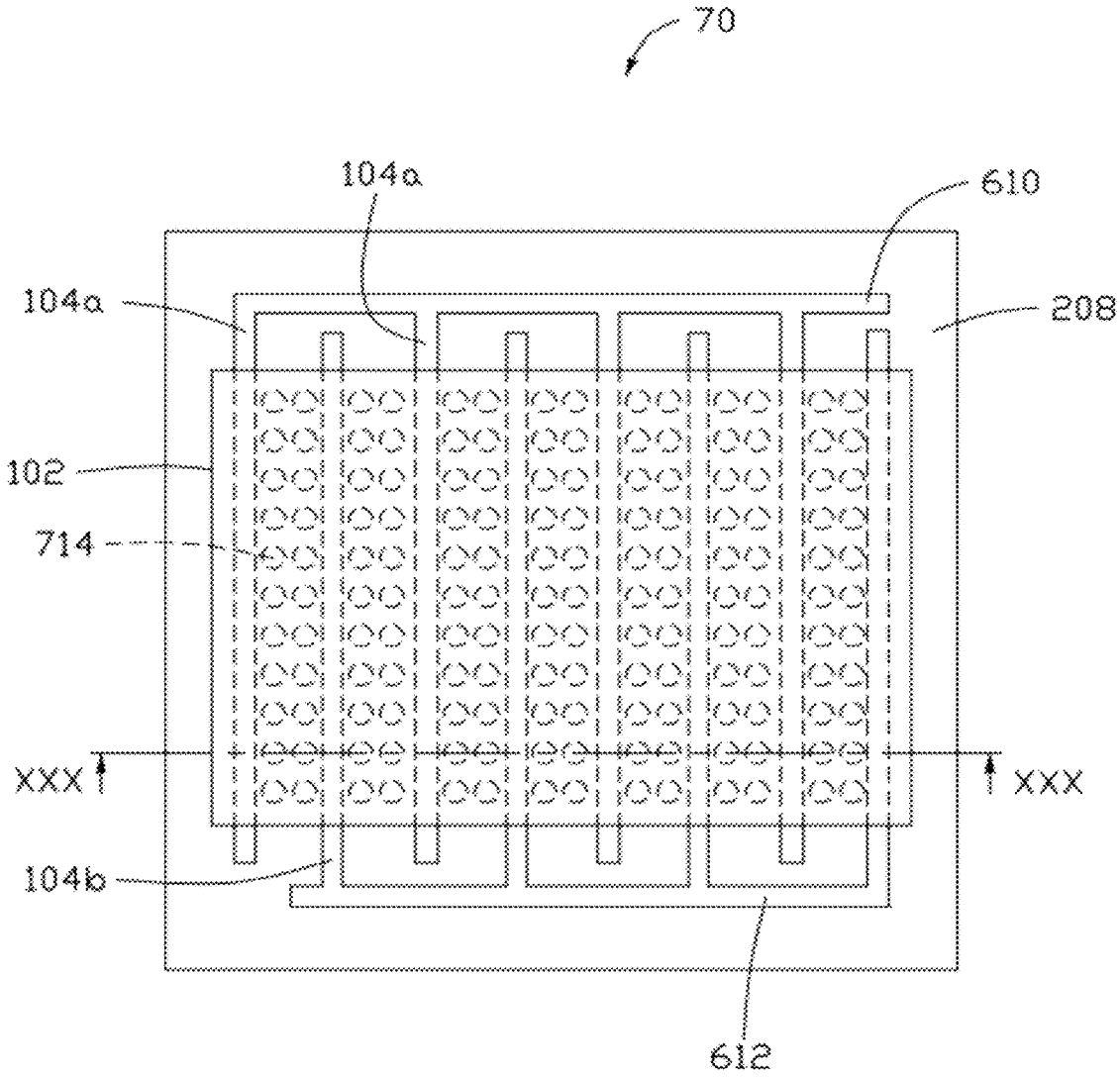
FIG. 29 is a schematic top plan view of one embodiment of a thermoacoustic device.
Figure 30:
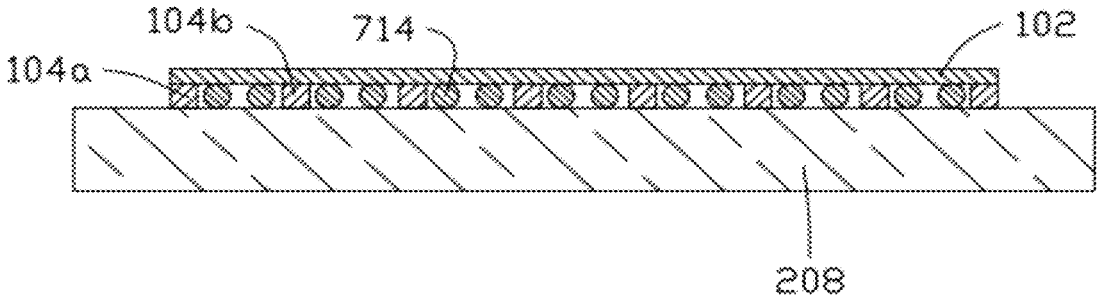
FIG. 30 is a cross-sectional view taken along a line XXX-XXX of the thermoacoustic device in FIG. 29.

Referring to FIGS. 29 and 30, a thermoacoustic device 70 according to one embodiment, includes a substrate 208, a number of first electrodes 104*a*, a number of second electrodes 104*b*, a number of spacers 714 and a sound wave generator 102.

The first electrodes 104*a* and the second electrodes 104*b* are located apart from each other on the substrate 208. The spacers 714 are located on the substrate 208 between the first electrode 104*a* and the second electrode 104*b*. The sound wave generator 102 is located on and supported by the spacer 714 and spaced from the substrate 208. The first electrodes 104*a* and the second electrodes 104*b* are arranged on the substrate 208 in an alternating staggered manner. All the first electrodes 104*a* are connected to the first conducting member 610. All the second electrodes 104*b* are connected to the second conducting member 612. The first conducting member 610 and the second conducting member 612 can be substantially perpendicular to the first and second electrodes 104*a*, 104*b*.

The spacers 714 can be located on the substrate 208 between every adjacent first electrode 104*a* and second electrode 104*b* and can be apart from each other by a substantially same distance. A distance between every two adjacent spacers 714 can be in a range from 10 microns to about 3 centimeters. The spacers 714, first electrodes 104*a* and the second electrodes 104*b* support the sound wave generator 102 and space the sound wave generator 102 from the substrate 208.

The spacer 714 can be integrated with the substrate 208 or separated from the substrate 208. The spacer 714 can be attached to the substrate 208 via a binder. The shape of the spacer 218 is not limited and can be dot, lamellar, rod, wire, and block, among other shapes. If the spacer 714 has a linear shape such as a rod or a wire, the spacer 714 can be substantially parallel to the electrodes 104*a*, 104*b*. To increase the contacting area of the sound wave generator 102, the spacer 714 and the sound wave generator 102 can be line-contacts or point-contacts. A material of the spacer 714 can be conductive materials such as metals, conductive adhesives, and indium tin oxides among other materials. The material of the spacer 714 can also be insulating materials such as glass, ceramic, or resin. A height of the spacer 714 is substantially equal to or smaller than the height of the electrodes 104*a*, 104*b*. The height of the spacer 714 is in a range from about 10 microns to about 1 centimeter.

A plurality of interval spaces (not labeled) is defined between the sound wave generator 102 and the substrate 208. Thus, the sound wave generator 102 can be sufficiently exposed to the surrounding medium and transmit heat into the surrounding medium. The height of the interval space (not labeled) is determined by the height of the spacer 714 and the first and second electrodes 104*a*, 104*b*. In order to prevent the sound wave generator 102 from generating standing waves, thereby maintaining good audio effects, the height of the interval space 2101 between the sound wave generator 102 and the substrate 208 can be in a range of about 10 microns to about 1 centimeter.

In one embodiment, as shown in FIGS. 29 and 30, the thermoacoustic device 70 includes four first electrodes 104*a* and four second electrodes 104*b*. There are two lines of spacers 714 between the adjacent first electrode 104*a* and the second electrode 104*b*.

In one embodiment, the spacer 714, the first electrode 104*a* and the second electrode 104*b* have a height of about 20 microns, and the height of the interval space between the sound wave generator 102 and the substrate 208 is about 20 microns.

The sound wave generator 102 is flexible. If the distance between the first electrode 104*a* and the second electrode 104*b* is large, the middle region of the sound wave generator 102 between the first and second electrodes 104*a*, 104*b* may sag and come into contact with the substrate 208. The spacer 714 can prevent the contact between the sound wave generator 102 and the substrate 208. Any combination of spacers 714 and electrodes 104*a*, 104*b* can be used.

Thermacoustic Device Including at Least Two Sound Wave Generators

Figure 31:
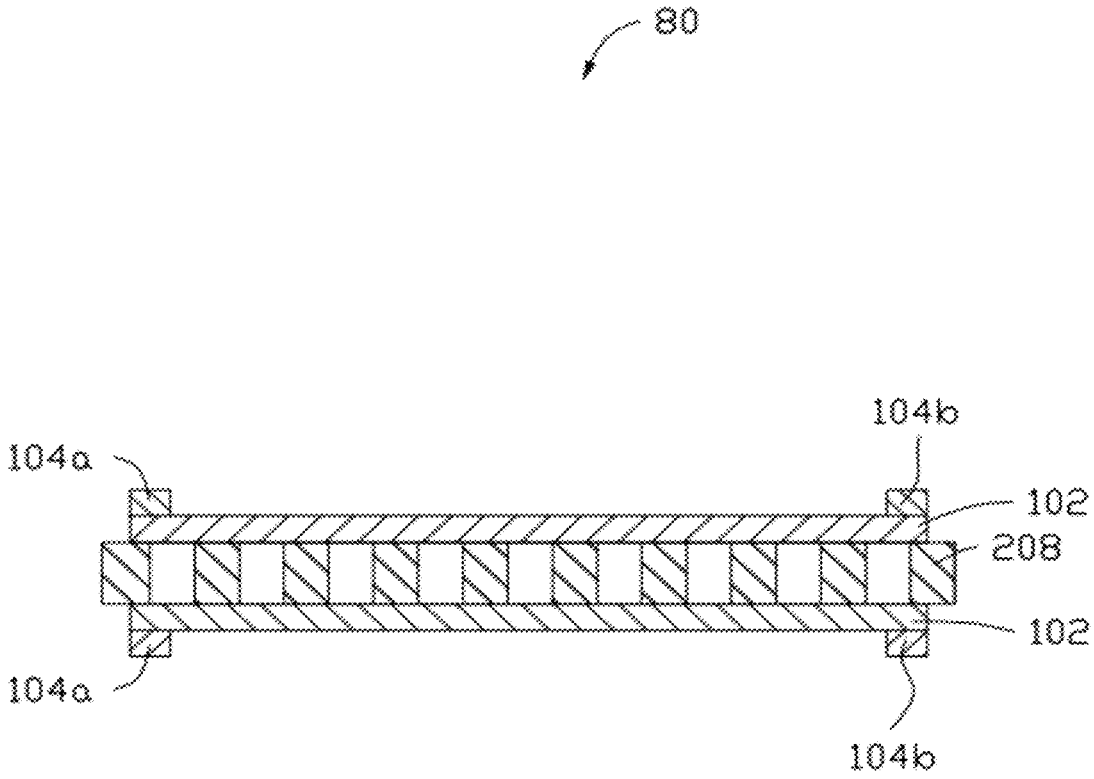
FIG. 31 is a cross-sectional side view of one embodiment of a thermoacoustic device.

Referring to FIG. 31, a thermoacoustic device 80 according to one embodiment, includes a substrate 208, two sound wave generators 102, two first electrodes 104*a* and two second electrodes 104*b*.

The substrate 208 has a first surface (not labeled) and a second surface (not labeled). The first surface and the second surface can be opposite with each other or adjacent with each other. In one embodiment according to FIG. 31, the first surface and the second surface are opposite with each other. The substrate 208 further includes a plurality of through holes 208*a* located between the first surface and the second surface. The plurality of through holes 208*a* can be substantially parallel with each other.

One sound wave generator 102 is located on the first surface of the substrate 208 and electrically connected with one first electrodes 104*a* and one second electrodes 104*b*. The other sound wave generator 102 is located on the second surface of the substrate 208 and electrically connected with the other one first electrode 104*a* and the other one second electrode 104*b*.

Figure 32:
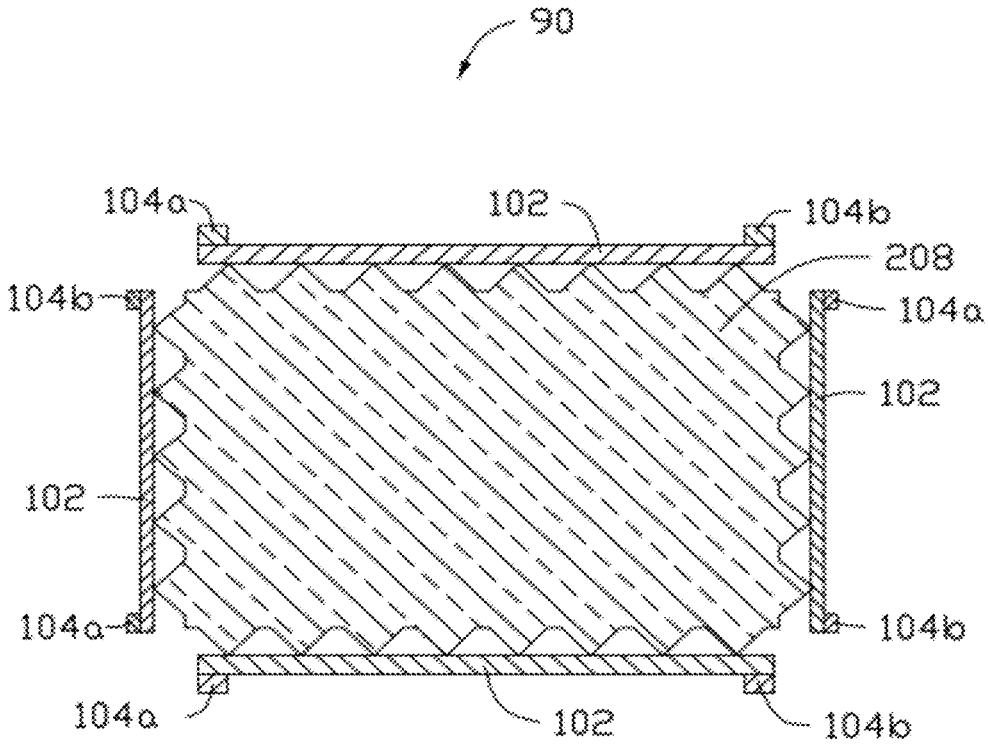
FIG. 32 is a cross-sectional side view of one embodiment of a thermoacoustic device.

Referring to FIG. 32, a thermoacoustic device 90 including a plurality of sound wave generators 102 is provided. The thermoacoustic device 90 includes a substrate 208. The substrate 208 includes a plurality of surfaces with one sound wave generator 102 is located on one surface. The thermoacoustic device 90 can further include a plurality of first electrodes 104*a* and a plurality of second electrodes 104*b*. Each sound wave generator 102 is electrically connected with one first electrode 104*a* and one second electrode 104*b*. In the embodiment according to FIG. 32, the thermoacoustic device 90 includes four sound wave generators 102, and the substrate 208 includes four surfaces. The four sound wave generators 102 are located on the four surfaces in a one by one manner. The surfaces can be planar, curved, or include some protuberances.

The thermoacoustic device including two or more sound wave generators 102 can emit sound waves to two or more different directions, and the sound generated from the thermoacoustic device can spread. Furthermore, if there is something wrong with one of the sound wave generators, the other sound wave generator can still work.

Thermacoustic Device Using Photoacoustic Effect

In one embodiment, the signal input device 104 can be a light source generating light signals, and the light signals can be directly incident to the sound wave generator 102 but not through the first and second electrodes 104*a*, 104*b*. The thermoacoustic device works under a photoacoustic effect. The photoacoustic effect is a conversion between light and acoustic signals due to absorption and localized thermal excitation. When rapid pulses of light are incident on a sample of matter, the light can be absorbed and the resulting energy will then be radiated as heat. This heat causes detectable sound signals due to pressure variation in the surrounding (i.e., environmental) medium.

Figure 33:
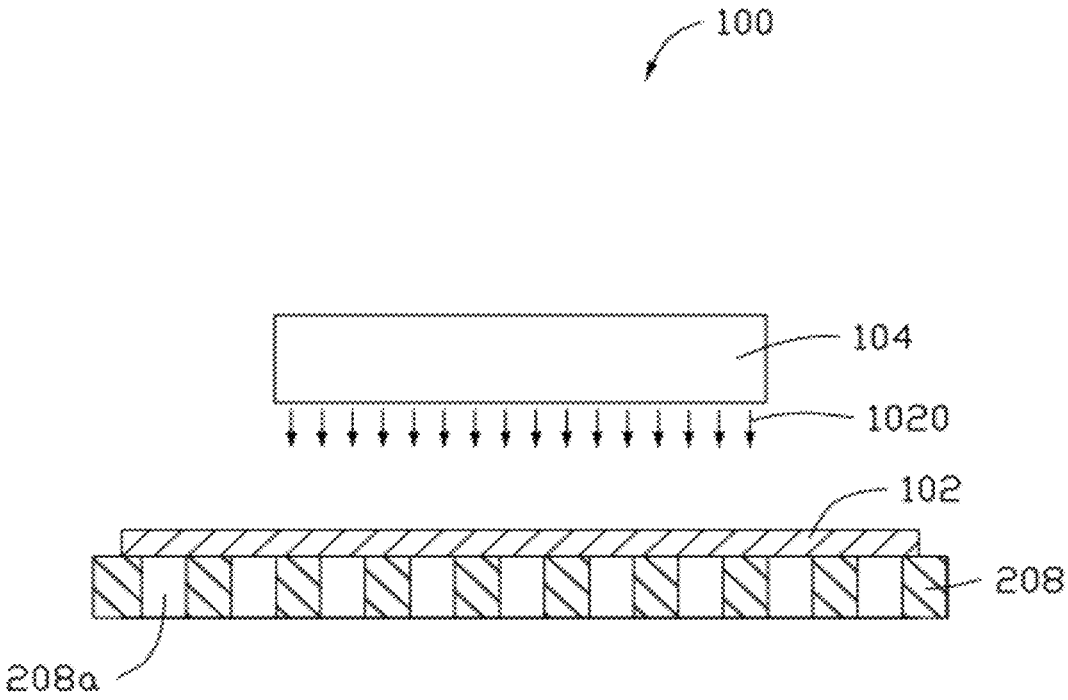
FIG. 33 is a cross-sectional side view of one embodiment of a thermoacoustic device.

Referring to FIG. 33, a thermoacoustic device 100 according to one embodiment includes a signal input device 104, a sound wave generator 102 and a substrate 208, but without the first and second electrodes. In the embodiment shown in FIG. 33, the substrate 208 has a top surface (not labeled), and defines at least one recess 208*a*. The sound wave generator 102 is located on the top surface of the substrate 208.

The signal input device 104 is located apart from the sound wave generator. The signal input device 104 can be a laser-producing device, a light source, or an electromagnetic signal generator. The signal input device 104 can transmit electromagnetic wave signals 1020 (e.g., laser signals and normal light signals) to the sound wave generator 102. In some embodiments, the signal input device 104 is a pulse laser generator (e.g., an infrared laser diode). A distance between the signal input device 104 and the sound wave generator 102 is not limited as long as the electromagnetic wave signal 1020 is successfully transmitted to the sound wave generator 102.

In the embodiment shown in FIG. 33, the signal input device 104 is a laser-producing device. The laser-producing device is located apart from the sound wave generator 102 and faces the sound wave generator 102. The laser-producing device can emit a laser. The laser-producing device faces the sound wave generator 102. In other embodiments, if the substrate 208 is made of transparent materials, the laser-producing device can be disposed on either side of the substrate 208. The laser signals produced by the laser-producing device can transmit through the substrate 208 to the sound wave generator 102.

The sound wave generator 102 absorbs the electromagnetic wave signals 1020 and converts the electromagnetic energy into heat energy. The heat capacity per unit area of the carbon nanotube film structure is extremely small, and thus, the temperature of the carbon nanotube film structure can change rapidly with the input electromagnetic wave signals 1020 at the substantially same frequency as the electromagnetic wave signals 1020. Thermal waves, which are propagated into surrounding medium, are obtained. Therefore, the surrounding medium, such as ambient air, can be heated at an equal frequency as the input of electromagnetic wave signal 1020 to the sound wage generator 102. The thermal waves produce pressure waves in the surrounding medium, resulting in sound wave generation. In this process, it is the thermal expansion and contraction of the medium in the vicinity of the sound wave generator 102 that produces sound. The operating principle of the sound wave generator 102 is the "optical-thermal-sound" conversion.

It is to be understood that the above-described embodiments are intended to illustrate rather than limit the present disclosure. Variations may be made to the embodiments without departing from the spirit of the present disclosure as claimed. Any elements discussed with any embodiment are envisioned to be able to be used with the other embodiments. The above-described embodiments illustrate the scope of the invention but do not restrict the scope of the present disclosure.

What is claimed is:

1. A thermoacoustic device comprising:

a sound wave generator comprising a composite structure comprising:

a carbon nanotube film structure comprising a plurality of carbon nanotubes and micropores; and a graphene film located on a surface of the carbon nanotube film structure, and covering the plurality of micropores, wherein the graphene film is supported by the carbon nanotube film structure; and a signal input device configured to input signals to the sound wave generator.

2. The thermoacoustic device of claim 1, wherein the carbon nanotube film structure comprises at least two crossed stacked drawn carbon nanotube films, and each of the drawn carbon nanotube films comprises a plurality of carbon nanotubes joined end-to-end by van der Walls attractive forces and oriented along a same direction.

3. The thermoacoustic device of claim 2, wherein each of the drawn carbon nanotube films has a thickness in a range from about 0.01 microns to about 100 microns.

4. The thermoacoustic device of claim 2, wherein each of the drawn carbon nanotube films comprises a plurality of stripped gaps.

5. The thermoacoustic device of claim 4, wherein a width of the plurality of stripped gaps is in a range from about 1 micrometer to about 10 micrometers.

6. The thermoacoustic device of claim 2, wherein each of the drawn carbon nanotube films comprises a plurality of carbon nanotube strips spaced from each other.

7. The thermoacoustic device of claim 6, wherein a distance between adjacent carbon nanotube strips of the plurality of carbon nanotube strips is in a range from about 10 micrometers to about 1000 micrometers.

8. The thermoacoustic device of claim 7, wherein a ratio of an area of the plurality of micropores of the carbon nanotube film structure is in a range from about 1000:1001 to about 10:11.

9. The thermoacoustic device of claim 1, wherein the signal input device comprises at least one first electrode and at least one second electrode, and the sound wave generator is electrically connected with the at least one first electrode and the at least one second electrode.

10. The thermoacoustic device of claim 9, wherein the signal input device comprises a plurality of first electrodes and a plurality of second electrodes, the plurality of first electrodes and the plurality of second electrodes are substantially parallel to each other and arranged in an alternating staggered manner.

11. The thermoacoustic device of claim 9, wherein each of the at least one first electrode and the at least one second electrode is a linear carbon nanotube structure comprising a plurality of carbon nanotubes joined end to end with each other, the plurality of carbon nanotubes are substantially parallel with each other and oriented along an axial direction of the linear carbon nanotube structure.

12. A thermoacoustic device comprising:

a substrate;

a sound wave generator located on a surface of the substrate, the sound wave generator comprising a composite structure comprising:

a carbon nanotube film structure comprising a plurality of carbon nanotubes and micropores; and a graphene film located on a surface of the carbon nanotube film structure and covering the plurality of micropores, wherein the graphene film is supported by the carbon nanotube film structure, and a ratio of an area of the plurality of micropores of the carbon nanotube film structure is in a range from about 1000:1001 to about 10:11; and a signal input device configured to input signals to the sound wave generator.

13. The thermoacoustic device of claim 12, wherein the signal input device comprises a plurality of first electrodes and a plurality of second electrodes, the plurality of first electrodes and the plurality of second electrodes are located between the substrate and the sound wave generator, and at least part of the sound wave generator is suspended above the substrate via the plurality of first electrodes and the plurality of second electrodes.

14. The thermoacoustic device of claim 12, wherein the substrate defines at least one recess through the surface, and the sound wave generator covers the at least one recess and is suspended via the at least one recess.

15. The thermoacoustic device of claim 14, wherein the at least one recess is a blind hole, through hole, blind groove, or through groove.

16. The thermoacoustic device of claim 14, wherein the substrate defines a plurality of recesses through the surface and located uniformly.

17. The thermoacoustic device of claim 12, further comprising a plurality of spacers located between the sound wave generator and the substrate, the sound wave generator is suspended above the substrate via the plurality of spacers.

18. The thermoacoustic device of claim 17, wherein the signal input device comprises at least one first electrode and at least one second electrode located between the sound wave generator and the substrate, the least one first electrode and at least one second electrode contact with the surface of the substrate and the sound wave generator, and the plurality of spacers is located on the surface of the substrate and between the at least one first electrode and the at least one second electrode.

19. A thermoacoustic device comprising:

a sound wave generator comprising a composite structure comprising:

a carbon nanotube film structure comprising a plurality of carbon nanotube wires crossed with each other thereby forming a network; and a graphene film located on and contacted with a surface of the carbon nanotube film structure, wherein the carbon nanotube film structure comprises a plurality of micropores, and the graphene film covers the plurality of micropores; and a signal input device configured to input signals to the sound wave generator.

20. The thermoacoustic device of claim 19, wherein a first part of the plurality of carbon nanotube wires is spaced from and substantially parallel to each other, a second part of the plurality of carbon nanotube wires is spaced from and substantially parallel to each other, the first and the second parts of the plurality of carbon nanotube wires are crossed with each other, and a distance between the adjacent first part and second part of the plurality of carbon nanotube wires is in a range from about 10 micrometers to about 1000 micrometers.

* * * * *